US008747781B2

(12) United States Patent
Bartfeld et al.

(10) Patent No.: US 8,747,781 B2
(45) Date of Patent: Jun. 10, 2014

(54) DENSITY PHASE SEPARATION DEVICE

(75) Inventors: Benjamin Bartfeld, Ringwood, NJ (US); Jamieson W. Crawford, Demarest, NJ (US); Robert G. Ellis, Wayne, NJ (US); Christopher A. Battles, Seymour, CT (US); Kenneth Handeland, Bernardsville, NJ (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 675 days.

(21) Appl. No.: 12/506,852

(22) Filed: Jul. 21, 2009

(65) Prior Publication Data

US 2010/0160135 A1 Jun. 24, 2010

Related U.S. Application Data

(60) Provisional application No. 61/082,365, filed on Jul. 21, 2008.

(51) Int. Cl.
*B04B 1/00* (2006.01)
*B01L 3/00* (2006.01)

(52) U.S. Cl.
CPC ..... *B01L 3/50215* (2013.01)
USPC ..... 422/548; 210/122; 210/782

(58) Field of Classification Search
CPC ..... B01L 3/50215; B04B 5/0414
USPC ..... 494/26; 210/113, 119–122; 422/533, 422/548
See application file for complete search history.

(56) References Cited

U.S. PATENT DOCUMENTS

| | | | |
|---|---|---|---|
| 2,577,780 | A | 12/1951 | Lockhart |
| 3,326,215 | A | 6/1967 | Sarnoff et al. |
| 3,508,653 | A | 4/1970 | Coleman |
| 3,543,338 | A | 12/1970 | Cooper |
| 3,647,070 | A | 3/1972 | Adler |
| 3,741,400 | A | 6/1973 | Dick |
| 3,771,965 | A | 11/1973 | Grams |
| 3,773,450 | A | 11/1973 | Svanfos |
| 3,779,383 | A | 12/1973 | Ayres |
| 3,780,935 | A | 12/1973 | Lukacs et al. |
| 3,786,985 | A | 1/1974 | Blaivas |

(Continued)

FOREIGN PATENT DOCUMENTS

| | | |
|---|---|---|
| DE | 19513453 C2 | 3/1997 |
| EP | 0137292 B1 | 3/1990 |

(Continued)

OTHER PUBLICATIONS

U.S. Appl. No. 12/506,841, filed Jul. 21, 2009, by Newby et al., "Density Phase Separation Device".

(Continued)

*Primary Examiner* — Timothy Cleveland
(74) *Attorney, Agent, or Firm* — The Webb Law Firm

(57) ABSTRACT

A mechanical separator for separating a fluid sample into first and second phases is disclosed. The mechanical separator includes a float, a ballast assembly longitudinally moveable with respect to the float, and a bellows structure. The bellows structure includes a first end, a second end, and a deformable bellows therebetween. The float is attached to a portion of the first end of the bellows structure, and the ballast is attached to a portion of the second end of the bellows structure. The attached float and bellows structure includes a releaseable interference engagement therebetween. The float has a first density, and the ballast has a second density that is greater than the first density of the float.

37 Claims, 17 Drawing Sheets

(56) References Cited

U.S. PATENT DOCUMENTS 3,809,733 A 5/1974 Sandiford et al.
3,814,248 A 6/1974 Lawhead
3,814,258 A 6/1974 Ayres
3,832,110 A 8/1974 Hehl
3,850,174 A 11/1974 Ayres
3,852,194 A 12/1974 Zine, Jr.
3,879,295 A 4/1975 Glover et al.
3,882,021 A 5/1975 Ayres
3,886,928 A 6/1975 Sarstedt
3,887,464 A 6/1975 Ayres
3,890,237 A 6/1975 Welch
3,890,954 A 6/1975 Greenspan
3,891,553 A 6/1975 Ayres
3,894,950 A 7/1975 Ayres et al.
3,894,951 A 7/1975 Ayres
3,894,952 A 7/1975 Ayres
3,897,337 A 7/1975 Ayres
3,897,343 A 7/1975 Ayres
3,901,219 A 8/1975 Kay
3,909,419 A 9/1975 Ayres
3,919,085 A 11/1975 Ayres
3,920,549 A 11/1975 Gigliello et al.
3,929,646 A 12/1975 Adler
3,931,018 A 1/1976 North, Jr.
3,932,277 A 1/1976 McDermott et al.
3,935,113 A 1/1976 Ayres
3,941,699 A 3/1976 Ayres
3,945,928 A 3/1976 Ayres
3,947,176 A 3/1976 Rainville
3,951,801 A 4/1976 Ayres
3,957,654 A 5/1976 Ayres
3,970,565 A 7/1976 Ahlstrand et al.
3,972,812 A 8/1976 Gresl, Jr.
3,981,804 A 9/1976 Gigliello
4,001,122 A 1/1977 Griffin
4,004,868 A 1/1977 Ohdate
4,021,340 A 5/1977 Zine, Jr.
4,027,660 A 6/1977 Wardlaw et al.
4,055,501 A 10/1977 Cornell
4,077,396 A 3/1978 Wardlaw et al.
4,083,788 A 4/1978 Ferrara
4,088,582 A 5/1978 Murty et al.
4,119,125 A 10/1978 Elkins
4,131,549 A 12/1978 Ferrara
4,152,270 A 5/1979 Cornell
4,154,690 A 5/1979 Ballies
4,159,896 A 7/1979 Levine et al.
4,169,060 A 9/1979 Columbus
4,189,385 A 2/1980 Greenspan
4,201,209 A 5/1980 LeVeen et al.
4,202,769 A 5/1980 Greenspan
4,243,362 A 1/1981 Rees et al.
4,246,123 A 1/1981 Cornell et al.
4,257,886 A 3/1981 Kessler
4,275,030 A 6/1981 Mares
4,279,863 A 7/1981 Friehler
4,294,707 A 10/1981 Ikeda et al.
4,315,892 A 2/1982 Stone et al.
4,364,832 A 12/1982 Ballies
4,369,117 A 1/1983 White
4,381,275 A 4/1983 Sorensen
4,396,381 A 8/1983 Fanger et al.
4,409,988 A 10/1983 Greenspan
4,417,981 A 11/1983 Nugent
4,425,235 A 1/1984 Cornell et al.
4,426,290 A 1/1984 Ichikawa et al.
4,443,345 A 4/1984 Wells
4,444,711 A 4/1984 Schad
4,448,741 A 5/1984 Schad
4,464,254 A 8/1984 Dojki et al.
4,470,936 A 9/1984 Potter
4,492,634 A 1/1985 Villa-Real
4,508,676 A 4/1985 Sorensen
4,517,090 A 5/1985 Kersten et al.
4,522,713 A 6/1985 Nussbaumer et al.
4,535,014 A 8/1985 Wright
4,567,754 A 2/1986 Wardlaw et al.
4,569,764 A 2/1986 Satchell
4,602,995 A 7/1986 Cassaday et al.
4,701,292 A 10/1987 Valyi
4,707,276 A 11/1987 Dodge et al.
4,717,324 A 1/1988 Schad et al.
4,726,758 A 2/1988 Sekine et al.
4,803,031 A 2/1989 Ochs et al.
4,818,386 A 4/1989 Burns
4,828,716 A 5/1989 McEwen et al.
4,832,851 A 5/1989 Bowers et al.
4,853,137 A 8/1989 Ersson
4,877,520 A 10/1989 Burns
4,917,801 A 4/1990 Luderer et al.
4,935,184 A 6/1990 Sorensen
4,957,637 A 9/1990 Cornell
4,957,682 A 9/1990 Kobayashi et al.
5,019,243 A 5/1991 McEwen et al.
5,028,226 A 7/1991 De'ath et al.
5,030,341 A 7/1991 McEwen et al.
5,086,784 A 2/1992 Levine et al.
5,236,604 A 8/1993 Fiehler
5,251,474 A 10/1993 Wardlaw et al.
5,269,927 A 12/1993 Fiehler
5,271,852 A 12/1993 Luoma, II
5,282,981 A 2/1994 Adams et al.
5,308,506 A 5/1994 McEwen et al.
5,325,977 A 7/1994 Haynes et al.
5,354,483 A 10/1994 Furse
5,389,265 A 2/1995 Luoma, II
5,393,494 A 2/1995 Greenfield et al.
5,419,835 A 5/1995 Adams et al.
5,454,958 A 10/1995 Fiehler
5,456,885 A 10/1995 Coleman et al.
5,533,518 A 7/1996 Vogler
5,556,541 A 9/1996 Ruschke
5,560,830 A 10/1996 Coleman et al.
5,575,778 A 11/1996 Hardt et al.
5,632,895 A 5/1997 Tsukagoshi et al.
5,632,905 A 5/1997 Haynes
5,651,998 A 7/1997 Bertschi et al.
5,707,876 A 1/1998 Levine
5,736,033 A 4/1998 Coleman et al.
5,755,360 A 5/1998 Elliott
5,785,925 A 7/1998 U'Ren
5,789,033 A 8/1998 Bertschi et al.
5,798,069 A 8/1998 Bertschi et al.
5,902,276 A 5/1999 Namey, Jr.
5,955,009 A 9/1999 Kazuma
6,001,087 A 12/1999 Zurcher
6,074,613 A 6/2000 Harness et al.
6,106,261 A 8/2000 von Holdt
6,174,447 B1 1/2001 Spindler
6,225,123 B1 5/2001 Cohen et al.
6,277,331 B1 8/2001 Konrad
6,280,400 B1 8/2001 Niermann
6,296,796 B1 10/2001 Gordon
6,379,139 B1 4/2002 Boucherie
6,390,966 B2 5/2002 Anderson
6,406,671 B1 6/2002 DiCesare et al.
6,409,528 B1 6/2002 Bodnar
6,464,921 B1 10/2002 Armbruster
6,465,256 B1 10/2002 Iskra
6,471,069 B2 10/2002 Lin et al.
6,479,298 B1 11/2002 Miller et al.
6,497,325 B1 12/2002 DiCesare et al.
6,516,953 B1 2/2003 DiCesare et al.
6,537,503 B1 3/2003 Conway
6,558,149 B1 5/2003 Bodmer et al.
6,582,904 B2 6/2003 Dahm
6,593,145 B2 7/2003 Macfarlane et al.
6,607,685 B2 8/2003 Naritomi et al.
6,623,688 B2 9/2003 Gedritis et al.
6,740,240 B2 5/2004 Coville et al.
6,758,804 B2 7/2004 Anderson
6,783,346 B2 8/2004 Bodmer et al.
6,793,892 B1 9/2004 Niermann
6,803,022 B2 10/2004 DiCesare et al.

(56) References Cited

U.S. PATENT DOCUMENTS

| | | | |
|---|---|---|---|
| 6,866,811 | B2 | 3/2005 | Kayano et al. |
| 6,933,148 | B2 | 8/2005 | Collins et al. |
| 6,976,509 | B1 | 12/2005 | Kirvan |
| 7,074,577 | B2 | 7/2006 | Haubert et al. |
| 7,077,273 | B2 | 7/2006 | Ellsworth et al. |
| 7,153,477 | B2 | 12/2006 | DiCesare et al. |
| 7,158,854 | B1 | 1/2007 | Kolander |
| 7,179,391 | B2 | 2/2007 | Leach et al. |
| 7,188,734 | B2 | 3/2007 | Konrad |
| 7,205,157 | B2 | 4/2007 | Jurgensen et al. |
| 7,211,433 | B1 | 5/2007 | Dahm et al |
| 7,220,593 | B2 | 5/2007 | Haubert et al. |
| 7,223,346 | B2 | 5/2007 | Dorian et al. |
| 7,282,168 | B2 | 10/2007 | Downer et al. |
| 7,294,311 | B2 | 11/2007 | Coville |
| 2002/0023884 | A1 | 2/2002 | Anderson |
| 2002/0094305 | A1 | 7/2002 | DiCesare et al. |
| 2002/0132367 | A1 | 9/2002 | Miller et al. |
| 2002/0156439 | A1 | 10/2002 | Iskra |
| 2002/0185778 | A1 | 12/2002 | Armbruster |
| 2003/0028154 | A1 | 2/2003 | Ross |
| 2003/0039717 | A1 | 2/2003 | Hwang et al. |
| 2003/0205538 | A1 | 11/2003 | Dorian et al. |
| 2004/0013575 | A1 | 1/2004 | Stevens et al. |
| 2004/0059255 | A1 | 3/2004 | Manoussakis et al. |
| 2004/0129631 | A1 | 7/2004 | Anraku et al. |
| 2004/0149287 | A1 | 8/2004 | Namey, Jr. |
| 2004/0166029 | A1 | 8/2004 | Losada et al. |
| 2004/0210196 | A1 | 10/2004 | Bush, Jr. et al. |
| 2004/0241364 | A1 | 12/2004 | Zihlmann |
| 2005/0033237 | A1 | 2/2005 | Fentress et al. |
| 2005/0037165 | A1 | 2/2005 | Ahern et al. |
| 2005/0059163 | A1 | 3/2005 | Dastane et al. |
| 2005/0170114 | A1 | 8/2005 | Hill |
| 2005/0186120 | A1 | 8/2005 | Dorian et al. |
| 2006/0032825 | A1 | 2/2006 | Ellsworth et al. |
| 2006/0036231 | A1 | 2/2006 | Conard et al. |
| 2006/0068206 | A1 | 3/2006 | Hala et al. |
| 2006/0089602 | A1 | 4/2006 | Boucherie |
| 2006/0263266 | A1 | 11/2006 | DiCesare et al. |
| 2007/0034579 | A1 | 2/2007 | Dorian et al. |
| 2007/0096364 | A1 | 5/2007 | Hahn et al. |
| 2007/0191775 | A1 | 8/2007 | Diep et al. |
| 2007/0267776 | A1 | 11/2007 | Conard et al. |
| 2008/0023414 | A1 | 1/2008 | Konrad |

FOREIGN PATENT DOCUMENTS

| | | | |
|---|---|---|---|
| EP | 0184274 | B1 | 5/1992 |
| EP | 0385953 | B1 | 4/1993 |
| EP | 0537507 | A1 | 4/1993 |
| EP | 0399151 | B1 | 8/1994 |
| EP | 0638804 | A1 | 2/1995 |
| EP | 0520184 | B1 | 1/1996 |
| EP | 0520185 | B1 | 2/1996 |
| EP | 0638171 | B1 | 6/1996 |
| EP | 0753741 | A1 | 1/1997 |
| EP | 0494079 | B1 | 3/1997 |
| EP | 0766973 | A1 | 4/1997 |
| EP | 0493838 | B1 | 5/1997 |
| EP | 0627261 | B1 | 5/1998 |
| EP | 0640215 | B1 | 11/1998 |
| EP | 0817680 | B1 | 12/1999 |
| EP | 0678557 | B1 | 6/2000 |
| EP | 1005910 | A2 | 6/2000 |
| EP | 1016460 | A2 | 7/2000 |
| EP | 0688606 | B1 | 12/2000 |
| EP | 1106252 | A2 | 6/2001 |
| EP | 0739229 | B1 | 10/2001 |
| EP | 0744026 | B1 | 11/2001 |
| EP | 1205250 | A1 | 5/2002 |
| EP | 1221342 | A2 | 7/2002 |
| EP | 0875757 | B1 | 6/2003 |
| EP | 0928301 | B1 | 1/2004 |
| EP | 1005909 | B1 | 5/2004 |
| EP | 1107002 | B1 | 8/2004 |
| EP | 1192996 | B1 | 8/2004 |
| EP | 1106250 | B1 | 4/2005 |
| EP | 1106251 | B1 | 11/2005 |
| EP | 1106253 | B1 | 11/2005 |
| EP | 1014088 | B1 | 3/2006 |
| EP | 1006360 | B1 | 5/2006 |
| EP | 1693109 | A1 | 8/2006 |
| EP | 1189967 | B1 | 3/2007 |
| EP | 1772191 | A1 | 4/2007 |
| EP | 1509326 | B1 | 6/2007 |
| EP | 1289618 | B1 | 1/2008 |
| GB | 2293986 | A | 4/1996 |
| JP | 55-55259 | A | 4/1980 |
| JP | 64-23166 | A | 1/1989 |
| JP | 1-295164 | A | 11/1989 |
| JP | 3270701 | A | 12/1991 |
| JP | 7-103969 | A | 4/1995 |
| JP | 8-201380 | A | 8/1996 |
| JP | 9292393 | A | 11/1997 |
| JP | 11-314011 | A | 11/1999 |
| JP | 2000-74910 | A | 3/2000 |
| JP | 2000199760 | A | 7/2000 |
| JP | 2003185653 | A | 7/2003 |
| JP | 2007-244925 | A | 9/2007 |
| WO | 9322673 | A1 | 11/1993 |
| WO | 9520675 | A1 | 8/1995 |
| WO | 9605770 | A1 | 2/1996 |
| WO | 9609308 | A1 | 3/1996 |
| WO | 9712679 | A1 | 4/1997 |
| WO | 9851411 | A2 | 11/1998 |
| WO | 0114850 | A1 | 3/2001 |
| WO | 0181002 | A1 | 11/2001 |
| WO | 0209840 | A1 | 2/2002 |
| WO | 02073190 | A1 | 9/2002 |
| WO | 03099412 | A1 | 12/2003 |
| WO | 2004030826 | A2 | 4/2004 |
| WO | 2004031770 | A1 | 4/2004 |
| WO | 2005014173 | A1 | 2/2005 |
| WO | 2005080965 | A1 | 9/2005 |
| WO | 2006104636 | A1 | 10/2006 |
| WO | 2006121728 | A2 | 11/2006 |
| WO | 2006135856 | A2 | 12/2006 |
| WO | 2007095450 | A2 | 8/2007 |
| WO | 2008049359 | A1 | 5/2008 |
| WO | 2008097091 | A1 | 8/2008 |
| WO | 2008127639 | A1 | 10/2008 |

OTHER PUBLICATIONS

U.S. Appl. No. 12/506,866, filed Jul. 21, 2009, by Battles et al., "Density Phase Separation Device".

DENSITY PHASE SEPARATION DEVICE

CROSS REFERENCE TO RELATED APPLICATION

This application claims priority to U.S. Provisional Patent Application No. 61/082,365, filed Jul. 21, 2008, entitled "Density Phase Separation Device", the entire disclosure of which is herein incorporated by reference.

BACKGROUND OF THE INVENTION

1. Field of the Invention

The subject invention relates to a device and method for separating heavier and lighter fractions of a fluid sample. More particularly, this invention relates to a device and method for collecting and transporting fluid samples whereby the device and fluid sample are subjected to centrifugation in order to cause separation of the heavier fraction from the lighter fraction of the fluid sample.

2. Description of Related Art

Diagnostic tests may require separation of a patient's whole blood sample into components, such as serum or plasma, (the lighter phase component), and red blood cells, (the heavier phase component). Samples of whole blood are typically collected by venipuncture through a cannula or needle attached to a syringe or an evacuated blood collection tube. After collection, separation of the blood into serum or plasma and red blood cells is accomplished by rotation of the syringe or tube in a centrifuge. In order to maintain the separation, a barrier must be positioned between the heavier and lighter phase components. This allows the separated components to be subsequently examined.

A variety of separation barriers have been used in collection devices to divide the area between the heavier and lighter phases of a fluid sample. The most widely used devices include thixotropic gel materials, such as polyester gels. However, current polyester gel serum separation tubes require special manufacturing equipment to both prepare the gel and fill the tubes. Moreover, the shelf-life of the product is limited. Over time, globules may be released from the gel mass and enter one or both of the separated phase components. These globules may clog the measuring instruments, such as the instrument probes used during the clinical examination of the sample collected in the tube. Furthermore, commercially available gel barriers may react chemically with the analytes. Accordingly, if certain drugs are present in the blood sample when it is taken, an adverse chemical reaction with the gel interface can occur.

Certain mechanical separators have also been proposed in which a mechanical barrier can be employed between the heavier and lighter phases of the fluid sample. Conventional mechanical barriers are positioned between heavier and lighter phase components utilizing differential buoyancy and elevated gravitational forces applied during centrifugation. For proper orientation with respect to plasma and serum specimens, conventional mechanical separators typically requires that the mechanical separator be affixed to the underside of the tube closure in such a manner that blood fill occurs through or around the device when engaged with a blood collection set. This attachment is required to prevent the premature movement of the separator during shipment, handling and blood draw. Conventional mechanical separators are affixed to the tube closure by a mechanical interlock between the bellows component and the closure. Example devices are described in U.S. Pat. Nos. 6,803,022 and 6,479,298.

Conventional mechanical separators have some significant drawbacks. As shown in FIG. 1, conventional separators include a bellows 34 for providing a seal with the tube or syringe wall 38. Typically, at least a portion of the bellows 34 is housed within, or in contact with a closure 32. As shown in FIG. 1, as the needle 30 enters through the closure 32, the bellows 34 is depressed. This creates a void 36 in which blood may pool when the needle 30 is removed. This can result in needle clearance issues, sample pooling under the closure, device pre-launch in which the mechanical separator prematurely releases during blood collection, hemolysis, fibrin draping and/or poor sample quality. Furthermore, previous mechanical separators are costly and complicated to manufacture due to the complicated multi-part fabrication techniques.

Accordingly, a need exists for a separator device that is compatible with standard sampling equipment and reduces or eliminates the aforementioned problems of conventional separators. A need also exists for a separator device that is easily used to separate a blood sample, minimizes cross-contamination of the heavier and lighter phases of the sample during centrifugation, is independent of temperature during storage and shipping and is stable to radiation sterilization.

SUMMARY OF THE INVENTION

The present invention is directed to an assembly and method for separating a fluid sample into a higher specific gravity phase and a lower specific gravity phase. Desirably, the mechanical separator of the present invention may be used with a tube, and the mechanical separator is structured to move within the tube under the action of applied centrifugal force in order to separate the portions of a fluid sample. Most preferably, the tube is a specimen collection tube including an open end, an closed end or an apposing end, and a sidewall extending between the open end and closed or apposing end. The sidewall includes an outer surface and an inner surface and the tube further includes a closure disposed to fit in the open end of the tube with a resealable septum. Alternatively, both ends of the tube may be open, and both ends of the tube may be sealed by elastomeric closures. At least one of the closures of the tube may include a needle pierceable resealable septum.

The mechanical separator may be disposed within the tube at a location between the top closure and the bottom of the tube. The separator includes opposed top and bottom ends and includes a float, a ballast assembly, and a bellows structure. The components of the separator are dimensioned and configured to achieve an overall density for the separator that lies between the densities of the phases of a fluid sample, such as a blood sample.

In one embodiment, the mechanical separator is adapted for separating a fluid sample into first and second phases within a tube. The mechanical separator includes a float, a ballast assembly longitudinally moveable with respect to the float, and a bellows structure. The bellows structure includes a first end, a second end, and a deformable bellows therebetween. The float may be attached to a portion of the first end of the bellows structure, and the ballast assembly may be attached to a portion of the second end of the bellows structure. The attached float and bellows structure also include a releasable interference engagement therebetween. The float may have a first density, and the ballast may have a second density greater than the first density of the float. The releaseable interference engagement may be configured to release upon the float exceeding a centrifugal force of at least 250 g.

The releaseable interference engagement of the mechanical separator may be adapted to release upon longitudinal deformation of the bellows structure. The bellows structure may also define an interior, and the float may be releasably retained within a portion of the interior of the bellows structure. The bellows structure may also include an interior flange, and at least a portion of the float may be retained within the interior of the first end by the interior flange.

The float of the mechanical separator may optionally include a neck portion, and the float may be releasably retained within a portion of the interior of the first end by a mechanical interference of the interior flange and the neck portion. In another configuration, the first end of the bellows structure may include an interior engagement portion facing the interior, and the float may include an exterior engagement portion for mechanical interface with the interior engagement portion. The first end of the bellows structure may also include a pierceable head portion having a puncture profile structured to resist deformation upon application of a puncture tip therethrough. The float may include a head portion defining an opening therethrough to allow the venting of air from within an interior of the float to an area exterior of the mechanical separator.

Optionally, the bellows may include a venting slit to allow the venting of air from within an interior of the float to an area exterior of the mechanical separator. The bellows may further include a venting slit to allow the venting of air from a chamber defined by an interior of the bellows and an exterior of the float to an area exterior of the mechanical separator.

In another configuration, the ballast assembly includes a plurality of ballast mating sections, such as a first ballast section and a second ballast section joined to the first ballast section through a portion of the bellows structure. The first ballast section and the second ballast section may be opposingly oriented about a longitudinal axis of the mechanical separator. The mechanical separator may also include a float made of polypropylene, a ballast assembly made of polyethylene terephthalate, and a bellows structure made of thermoplastic elastomer. The separation assembly includes a moveable plug disposed within an interior of the float.

In another embodiment, the mechanical separator for separating a fluid sample into first and second phases within a tube includes a bellows structure having a first end, a second end, and a deformable bellows therebetween. The mechanical separator also includes a float and ballast assembly longitudinally moveable with respect to the float. The ballast assembly includes a first ballast section and a second ballast section joined to the first ballast section through a portion of the bellows structure. The float may have a first density, and the ballast assembly may have a second density greater than the first density of the float.

The float of the mechanical separator may be attached to a portion of the first end of the bellows structure, and the ballast may be attached to a portion of the second end of the bellows structure. The attached float and bellows structure may further include a releaseable interference engagement therebetween. In one configuration, the bellows structure of the mechanical separator defines an interior, and the float is releasably retained within a portion of the interior of the bellows structure.

In another configuration, the first ballast section and the second ballast section of the ballast assembly are opposingly oriented about a longitudinal axis of the mechanical separator.

Optionally, the float may include a head portion defining an opening therethrough to allow the venting of air from within an interior of the float to an area exterior of the mechanical separator. The bellows may include a venting slit to allow the venting of air from within an interior of the float to an area exterior of the mechanical separator. The bellows may further include a venting slit to allow the venting of air from a chamber defined by an interior of the bellows and an exterior of the float to an area exterior of the mechanical separator.

In another embodiment, a separation assembly for enabling separation of a fluid sample into first and second phases includes a tube, having an open end, an apposing end, and a sidewall extending therebetween. A closure adapted for sealing engagement with the open end of the tube is also included. The closure defines a recess, and a mechanical separator is releasably engaged within the recess. The mechanical separator includes a float, a ballast assembly longitudinally moveable with respect to the float, and a bellows structure. The bellows structure includes a first end, a second end, and a deformable bellows therebetween. The float may be attached to a portion of the first end of the bellows structure, and the ballast assembly may be attached to a portion of the second end of the bellows structure. The attached float and bellows structure also includes a releaseable interference engagement therebetween. The float may have a first density, and the ballast may have a second density greater than the first density of the float.

The bellows structure of the separation assembly may define an interior, and the float may be releasably retained within a portion of the interior of the bellows structure. Release of the float from the first end of the bellows structure may release the mechanical separator from the recess of the closure. Optionally, the bellows structure includes a pierceable head portion having a puncture profile structured to resist deformation upon application of a puncture tip therethrough. The float may also have a head portion defining an opening and including a perimeter substantially corresponding to a portion of the puncture profile of the pierceable head portion.

In another configuration, the ballast assembly of the separation assembly includes a first ballast section and a second ballast section joined to the first ballast section through a portion of the bellows structure. The first ballast section and the second ballast section may be opposingly oriented about a longitudinal axis of the mechanical separator.

Optionally, the float may include a head portion defining an opening therethrough to allow the venting of air from within an interior of the float to an area exterior of the mechanical separator. The bellows may include a venting slit to allow the venting of air from within an interior of the float to an area exterior of the mechanical separator. The bellows may further include a venting slit to allow the venting of air from a chamber defined by an interior of the bellows and an exterior of the float to an area exterior of the mechanical separator. In another configuration, the separation assembly includes a moveable plug disposed within an interior of the float.

In another embodiment, a method of assembling a mechanical separator includes the step of providing a sub-assembly having a first end and a second end. The sub-assembly includes a ballast at least partially disposed about a bellows structure and defining a pierceable head portion. The method also includes the step of inserting a first end of the sub-assembly into a recess of a closure to provide mechanical interface between the bellows structure and the closure. The method also includes the step of inserting a float into the second end of the sub-assembly.

In another embodiment of the present invention, a separation assembly for enabling separation of a fluid sample into first and second phases includes a tube having at least one open end, a second end, and a sidewall extending therebetween. The separation assembly also includes a closure adapted for sealing engagement with the open end of the tube, with the closure defining a recess. A mechanical separator is releasably engaged within the recess. The mechanical separator includes a float, a ballast assembly longitudinally moveable with respect to the float, and a bellows structure. The bellows structure includes a first end, a second end, and a deformable bellows therebetween. The bellows structure abuts a portion of the closure recess, wherein the float releases from the bellows prior to the bellows releasing from the recess upon exposure of the separation assembly to centrifugal force.

Optionally, the float releases from the bellows prior to the bellows releasing from the recess upon exposure of the separation assembly to a centrifugal force of at least 250 g.

In another embodiment of the present invention, a separation assembly for enabling separation of a fluid sample into first and second phases includes a tube having at least one open end, a second end, and a sidewall extending therebetween. The separation assembly also includes a closure adapted for sealing engagement with the open end of the tube, with the closure defining a recess. A mechanical separator is releasably engaged within the recess. The mechanical separator includes a float, a ballast assembly longitudinally moveable with respect to the float, and a bellows structure. The bellows structure includes a first end, a second end, and a deformable bellows therebetween. The bellows structure abuts a portion of the closure recess, wherein the float releases from the bellows enabling the mechanical separator to release from the recess upon exposure of the separation assembly to centrifugal force.

Optionally, the float releases from the bellows enabling the mechanical separator to release from the recess upon exposure of the separation assembly to a centrifugal force of at least 250 g.

The assembly of the present invention is advantageous over existing separation products that utilize separation gel. In particular, the assembly of the present invention will not interfere with analytes, whereas many gels interact with bodily fluids. Another attribute of the present invention is that the assembly of the present invention will not interfere with therapeutic drug monitoring analytes.

The assembly of the present invention is also advantageous over existing mechanical separators in that the float provides a mechanical interference with the bellows structure to prevent premature release of the mechanical separator from the closure. This minimizes device needle clearance issues, sample pooling under the closure, device pre-launch, hemolysis, fibrin draping, and/or poor sample quality. In addition, pre-launch may be further minimized by precompression of the pierceable head of the bellows against the interior of the stopper.

Additionally, the assembly of the present invention does not require complicated extrusion techniques during fabrication. The assembly of the present invention also does not occlude conventional analysis probes, as is common with prior gel tubes.

Further details and advantages of the invention will become clear from the following detailed description when read in conjunction with the accompanying drawings.

DESCRIPTION OF THE PREFERRED EMBODIMENTS

Figure 1:
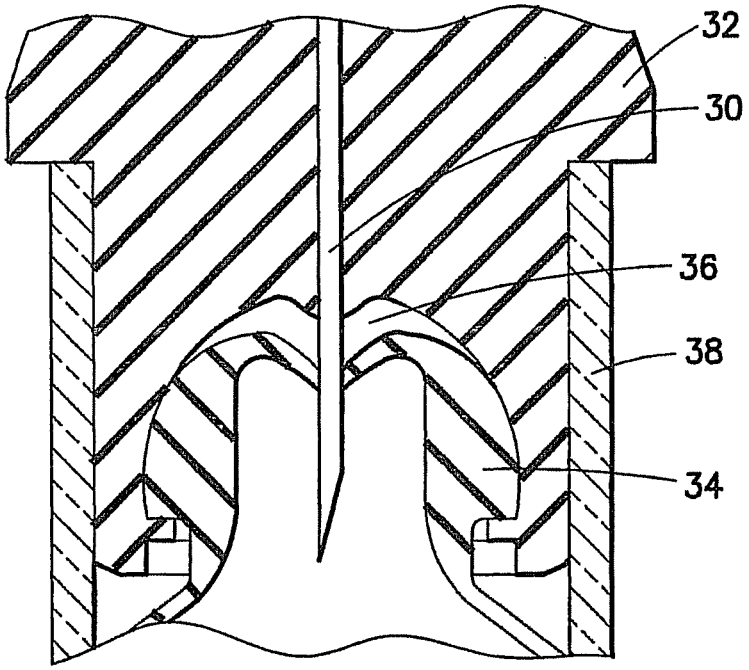
FIG. 1 PRIOR ART
FIG. 1 is a partial cross-sectional side view of a conventional mechanical separator.

For purposes of the description hereinafter, the words "upper", "lower", "right", "left", "vertical", "horizontal", "top", "bottom", "lateral", "longitudinal" and like spatial terms, if used, shall relate to the described embodiments as oriented in the drawing figures. However, it is to be understood that many alternative variations and embodiments may be assumed except where expressly specified to the contrary. It is also to be understood that the specific devices and embodiments illustrated in the accompanying drawings and described herein are simply exemplary embodiments of the invention.

Figure 2:
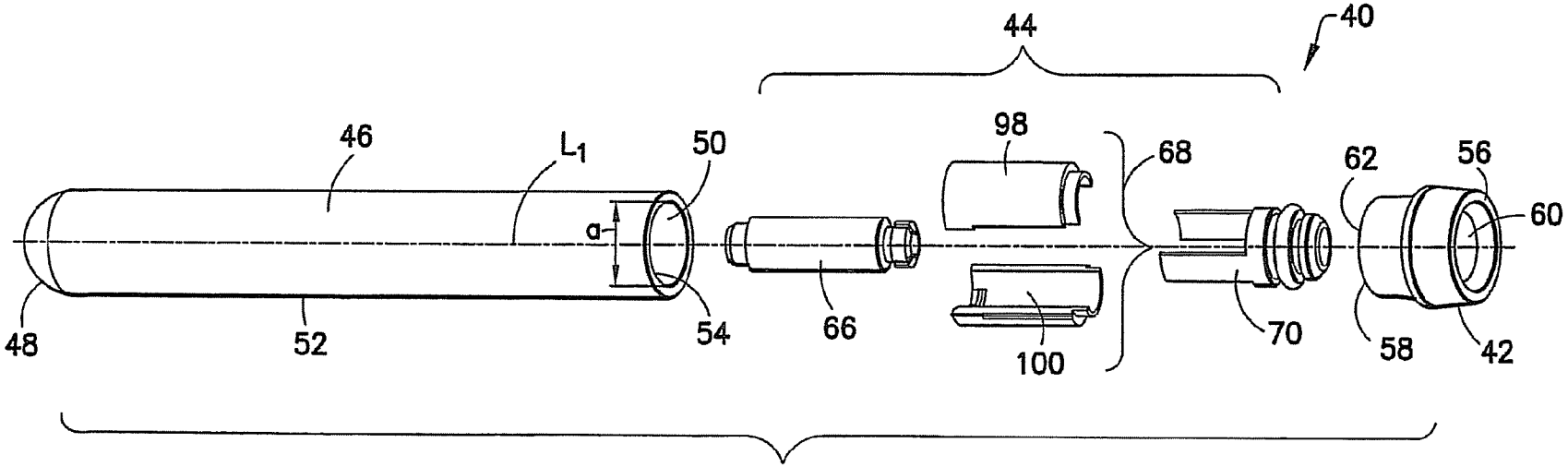
FIG. 2 is an exploded perspective view of a mechanical separator assembly including a closure, a bellows structure, a ballast assembly, a float, and a collection tube in accordance with an embodiment of the present invention.

As shown in exploded perspective view in FIG. 2, the mechanical separation assembly 40 of the present invention includes a closure 42 with a mechanical separator 44, for use in connection with a tube 46 for separating a fluid sample into first and second phases within the tube 46. The tube 46 may be a sample collection tube, such as a sample collection tube used for in-vitro diagnostics, clinical research, pharmaceutical research, proteomics, molecular diagnostics, chemistry-related diagnostic sample tubes, blood collection tubes, or other bodily fluid collection tube, coagulation sample tube, hematology sample tube, and the like. Desirably, tube 46 is an evacuated blood collection tube. In one embodiment, the tube 46 may contain additional additives as required for particular testing procedures, such as clotting inhibiting agents, clotting agents, stabilization additives and the like. Such additives may be in particle or liquid form and may be sprayed onto the cylindrical sidewall 52 of the tube 46 or located at the bottom of the tube 46. The tube 46 includes a closed bottom end 48, an open top end 50, and a cylindrical sidewall 52 extending therebetween. The cylindrical sidewall 52 includes an inner surface 54 with an inside diameter "a" extending substantially uniformly from the open top end 50 to a location substantially adjacent the closed bottom end 48.

The tube 46 may be made of one or more than one of the following representative materials: polypropylene, polyethylene terephthalate (PET), glass, or combinations thereof. The tube 46 can include a single wall or multiple wall configurations. Additionally, the tube 46 may be constructed in any practical size for obtaining an appropriate biological sample. For example, the tube 46 may be of a size similar to conventional large volume tubes, small volume tubes, or microtainer tubes, as is known in the art. In one particular embodiment, the tube 46 may be a standard 3 ml evacuated blood collection tube, as is also known in the art. In another embodiment, the tube 46 may have a 16 mm diameter and a length of 100 mm, with a blood draw capacity of 8.5 ml or 13 mm.

Figure 3:
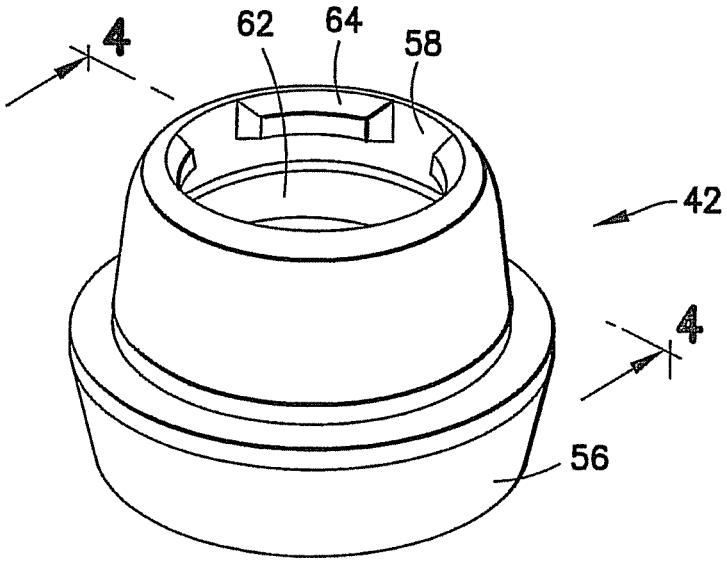
FIG. 3 is a perspective view of the bottom surface of the closure of FIG. 2.
Figure 4:
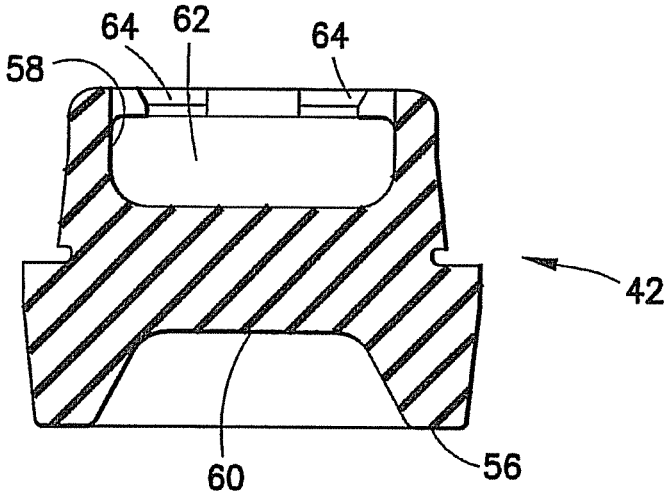
FIG. 4 is a cross-sectional view of the closure of FIG. 2 taken along line 4-4 of FIG. 3.
Figure 5:
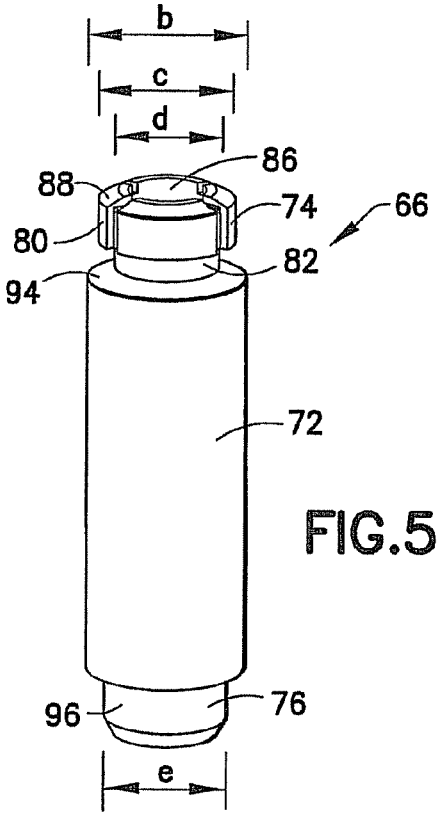
FIG. 5 is a perspective view of the float of FIG. 2.

The open top end 50 is structured to at least partially receive the closure 42 therein to form a liquid impermeable seal. The closure includes a top end 56 and a bottom end 58 structured to be at least partially received within the tube 46. Portions of the closure 42 adjacent the top end 56 define a maximum outer diameter which exceeds the inside diameter "a" of the tube 46. As shown in FIGS. 2-4, portions of the closure 42 at the top end 56 include a central recess 60 which define a pierceable resealable septum. Portions of the closure 42 extending downwardly from the bottom end 58 may taper from a minor diameter which is approximately equal to, or slightly less than, the inside diameter "a" of the tube 46 to a major diameter that is greater than the inside diameter "a" of the tube 46 adjacent the top end 56. Thus, the bottom end 58 of the closure 42 may be urged into a portion of the tube 46 adjacent the open top end 50. The inherent resiliency of closure 42 can insure a sealing engagement with the inner surface of the cylindrical sidewall 52 of the tube 46.

In one embodiment, the closure 42 can be formed of a unitarily molded rubber or elastomeric material, having any suitable size and dimensions to provide sealing engagement with the tube 46. The closure 42 can also be formed to define a bottom recess 62 extending into the bottom end 58. The bottom recess 62 may be sized to receive at least a portion of the mechanical separator 44. Additionally, a plurality of spaced apart arcuate flanges 64 may extend around the bottom recess 62 to at least partially restrain the mechanical separator 44 therein.

Referring again to FIG. 2, the mechanical separator 44 includes a float 66, a ballast assembly 68, and a bellows structure 70 such that the float 66 is engaged with a portion of the bellows structure 70 and the ballast assembly 68 is also engaged with a portion of the bellows structure 70.

Referring to FIGS. 5-9, the float 66 of the mechanical separator is a generally tubular body 72 having an upper end 74, a lower end 76, and a passage 78 extending longitudinally therebetween. The upper end 74 may include a head portion 80 separated from the generally tubular body 72 by a neck portion 82. The float 66 is substantially symmetrical about a longitudinal axis L. In one embodiment, the outer diameter "b" of the tubular body 72 is less than the inside diameter "a" of the tube 46, shown in FIG. 2. The outer diameter "c" of the head portion 80 is typically smaller than the outer diameter "b" of the tubular body 72. The outer diameter "d" of the neck portion 82 is less than the outer diameter "b" of the tubular body 72 and is also less than the outer diameter "c" of the head portion 80.

The head portion 80 of the float 66 includes an upper surface 84 defining an opening 86 therethrough to allow the venting of air. In one embodiment, a plurality of openings such as for example four openings 86*a* may be disposed at an angle of 90° to one another to enable venting of air therethrough. As shown in a close-up view in FIG. 8 taken along section VIII of FIG. 7, the opening 86 may include a recess extending into the upper surface 84, or a protrusion extending upwardly from the upper surface 84. The portion 86 may be substantially square or circular and may be continuous about the float 66. The portion 86 is typically recessed inward from the outer diameter "c" of the head portion 80. In addition, the opening 86 of the head portion 80 of the float 66 may be structured to allow a puncture tip, shown in FIGS. 25-26, to pass therethrough.

Referring again to FIGS. 5-9, the upper surface 84 of the head portion 80 may also include a slanted perimeter region 88 adjacent the outer diameter "c" of the head portion 80 having a slope angle A. In one embodiment, the slope angle A is from about 15 degrees to about 25 degrees, such as about 20 degrees. In another embodiment, the head portion 80 may also include a lower surface 90 adjacent the neck portion 82. The lower surface may also include a slope angle B of from about 8 degrees to about 12 degrees, such as about 10 degrees.

The tubular body 72 of the float 66 may include a shoulder region 94 adjacent the neck portion 82. The shoulder region 94 may include a slope angle C of from about 15 degrees to about 25 degrees, such as about 20 degrees. The lower end 76 of the float 66 may include a graduated portion 96 having an outer diameter "e" that is less than the outer diameter "b" of the tubular body 72. In an alternative embodiment, the lower end 76 may be a mirror image of head portion 80, so that the float is symmetrical along a longitudinal axis.

In one embodiment, it is desirable that the float 66 of the mechanical separator 44 be made from a material having a density lighter than the liquid intended to be separated into two phases. For example, if it is desired to separate human blood into serum and plasma, then it is desirable that the float 66 have a density of no more than about 0.902 gm/cc. In another embodiment, the float 66 can be formed from polypropylene.

As shown in FIG. 2, the ballast assembly 68 of the mechanical separator 44 may include a plurality of ballast portions, such as a first ballast portion 98 and a second ballast portion 100. The first ballast section 98 and the second ballast section 100 may be opposingly oriented about a longitudinal axis $L_1$ of the mechanical separator 44. In one embodiment, the first ballast portion 98 and the second ballast portion 100 are symmetric with respect to each other and are mirror images thereof. Therefore, although only the first ballast section 98 is shown in FIGS. 10-13, it is understood herein that the second ballast portion 100 is a mirror image of the first ballast portion 98. Taken together in opposing orientation, the first ballast portion 98 and the second ballast portion 100 of the ballast assembly 68 have a substantially cylindrical shape. Alternatively, it is contemplated herein that the ballast assembly 68 may consist of more than two mating portions, i.e., a first ballast portion 98 and a second ballast portion 100. In one embodiment, the ballast assembly may comprise three mating ballast portions or four or more mating ballast portions.

As shown in FIGS. 10-13, the first ballast portion 98 of the mechanical separator 44 includes a curved sidewall 102 having an interior surface 104 and an exterior surface 106. The curved sidewall 102 has a curvature and dimensions substantially corresponding to the curvature and dimensions of the inner surface 54 of the tube 46, shown in FIG. 2, such that the first ballast portion 98 can slide within the interior of the tube 46. The first ballast portion 98 has an upper end 108 and a lower end 110 and an arcuate body 111 extending therebetween. Adjacent the upper end 108 of the first ballast portion 98 is a receiving recess 112 disposed within the exterior surface 106 of the first ballast portion 98. The receiving recess 112 may extend along the entire curvature of the upper end 108 of the exterior surface 106. In one embodiment, the receiving recess 112 may be provided as a binding surface between the float 66 and the first ballast portion 98 and/or the second ballast portion 100 for two-shot molding techniques. Optionally, a second receiving recess 114 may be included adjacent the lower end 110 of the first ballast portion 98. The first ballast portion 98 also has an outer diameter "h" of the upper end 108 that is less than the outer diameter "g" of the arcuate body 111.

Referring again to FIGS. 10-13, the first ballast portion 98 may include an interior restraint 118 extending from the interior surface 104 into an interior defined by the curvature of the interior surface 104. The interior restraint 118 may have a curvature angle D extending along the interior surface 104 of the first ballast portion 98. In one embodiment, the curvature angle D is from about 55 degrees to about 65 degrees, such as about 60 degrees. In another embodiment, the interior restraint 118 is upwardly angled at an angle E of from about 40 degrees to about 50 degrees, such as about 45 degrees.

In one embodiment, it is desirable that the ballast assembly 68 of the mechanical separator 44 be made from a material having a density heavier than the liquid intended to be separated into two phases. For example, if it is desired to separate human blood into serum and plasma, then it is desirable that the ballast assembly 68 have a density of at least 1.326 gm/cc. The ballast assembly 68, including the first ballast portion 98 and the second ballast portion 100, may have a density that is greater than the density of the float 66, shown in FIGS. 5-9. In one embodiment, the ballast assembly 68 can be formed from PET. The first ballast portion 98 and the second ballast portion 100 may be molded or extruded as two separate pieces but fabricated at the same time in a single mold.

As shown in FIGS. 14-17, the bellows structure 70 of the mechanical separator 44 includes an upper first end 120, a lower second end 122, and a deformable bellows 124 circumferentially disposed therebetween. The upper first end 120 of the bellows structure 70 includes a pierceable head portion 126 including a substantially flat portion 128 surrounded by a generally curved shoulder 130 for correspondingly mating to the shape of the bottom recess 62 of the closure 42, shown in FIGS. 2-4. In one embodiment, the substantially flat portion 128 may be curved with a nominal radius of about 0.750 inch. In one embodiment, the generally curved shoulder 130 has a curvature angle F of from about 35 degrees to about 45 degrees, such as about 40 degrees. The substantially flat portion 128 can have any suitable dimensions, however, it is preferable that the substantially flat portion 128 has a diameter of from about 0.285 inch to about 0.295 inch. The substantially flat portion 128 of the pierceable head portion 126 is structured to allow a puncture tip, shown in FIGS. 25-26, such as a needle tip, needle cannula, or probe, to pass therethrough. In one embodiment, the pierceable head portion 126 has a thickness sufficient to allow the entire penetrating portion of the puncture tip to be disposed therein before penetrating therethrough. Upon withdrawal of the puncture tip from the flat portion 128 of the pierceable head portion 126, the pierceable head portion 126 is structured to reseal itself to provide a liquid impermeable seal. The pierceable head portion 126 of the mechanical separator 44 may be extruded and/or molded of a resiliently deformable and self-sealable material, such as thermoplastic elastomer. Optimally, the pierceable head portion 126 may be vented with a plurality of slits, such as these slits, created by a post-molding operation to vent the mechanical separator 44.

Figure 19:
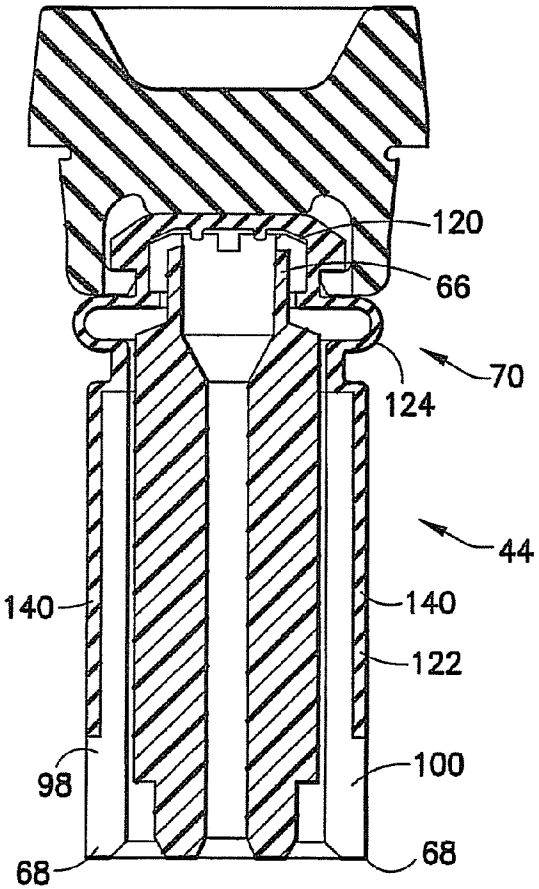
FIG. 19 is a cross-sectional view of the mechanical separator of FIG. 18 taken along line 19-19 of FIG. 18.
Figure 18:
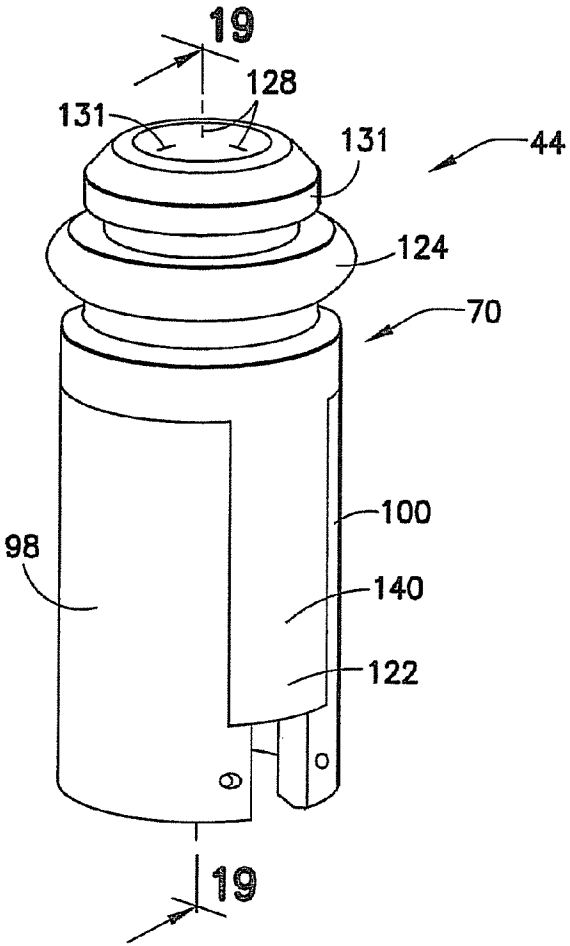
FIG. 18 is a perspective view of an assembled mechanical separator including a float, a ballast assembly, and a bellows structure in accordance with an embodiment of the present invention.

Referring to FIG. 19, in one embodiment, the deformable bellows 124 may include venting slits 131 for venting in two locations, such as in the chamber created by the interior of the float 66 and the chamber created by the interior of the deformable bellows 124 and the exterior of the float 66. These slits may be created by a post-molding procedure. During centrifuge, once the mechanical separator 70 is released from the closure 42, and the mechanical separator 70 becomes immersed in fluid, air is subsequently vented through the slits. The slits 131 may be arranged radially around the deformable bellows 124 and may have a length of from about 0.05 inch to about 0.075 inch, measured on the inside surface of the deformable bellows 124.

Figure 8:
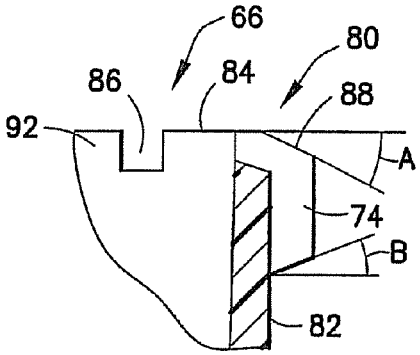
FIG. 8 is a close-up cross-sectional view of the float of FIG. 2 taken along section VIII of FIG. 7.
Figure 9:
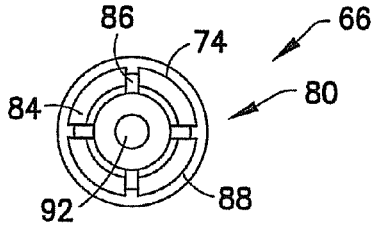
FIG. 9 is a top view of the float of FIG. 2.
Figure 10:
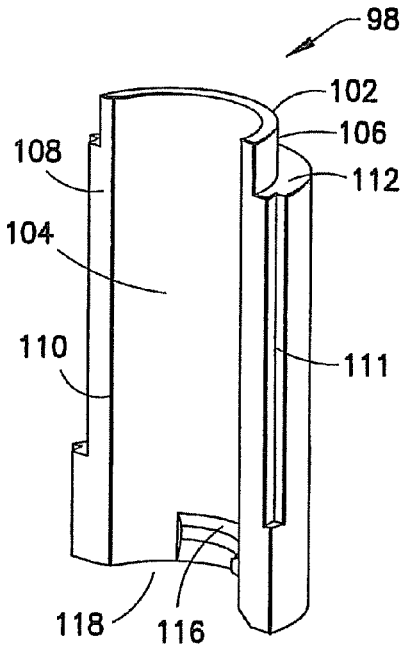
FIG. 10 is perspective view of a first portion of the ballast assembly of FIG. 2.
Figure 11:
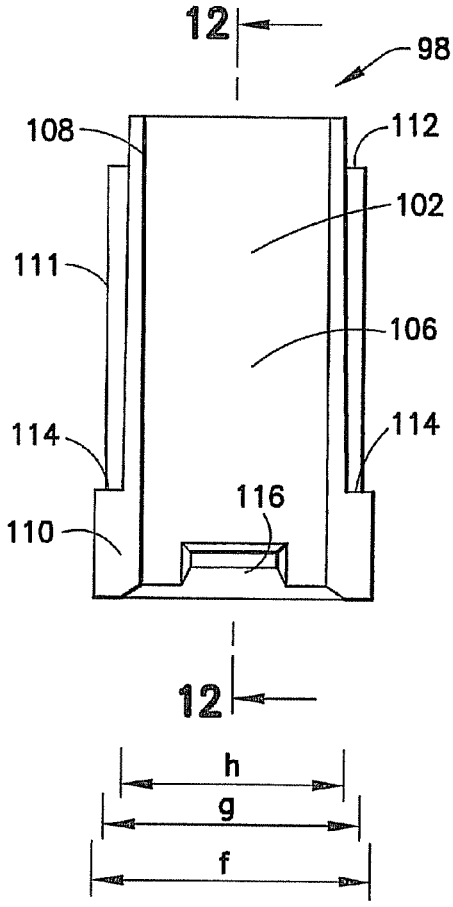
FIG. 11 is a front view of the first portion of the ballast assembly of FIG. 2.
Figure 12:
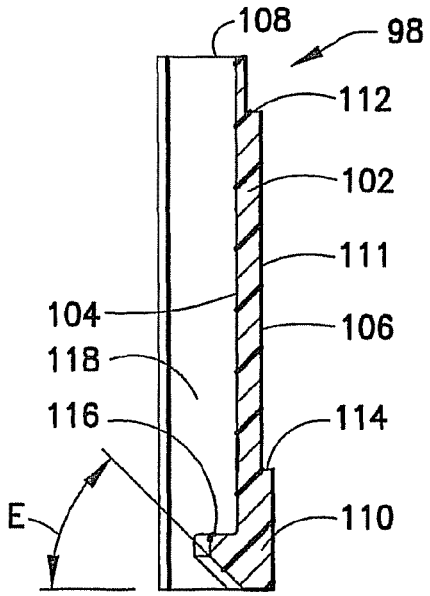
FIG. 12 is a cross-sectional view of the first portion of the ballast assembly of FIG. 2 taken along line 12-12 of FIG. 11.
Figure 13:
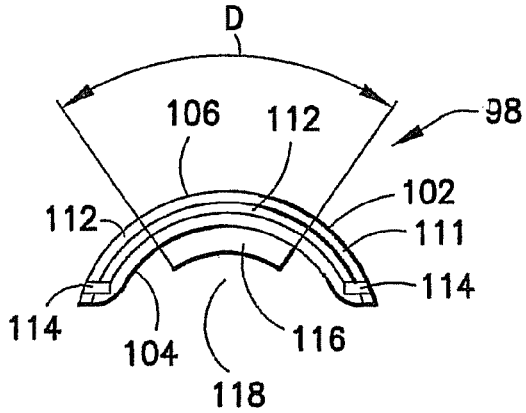
FIG. 13 is a top view of the first portion of the ballast assembly of FIG. 2.
Figure 15:
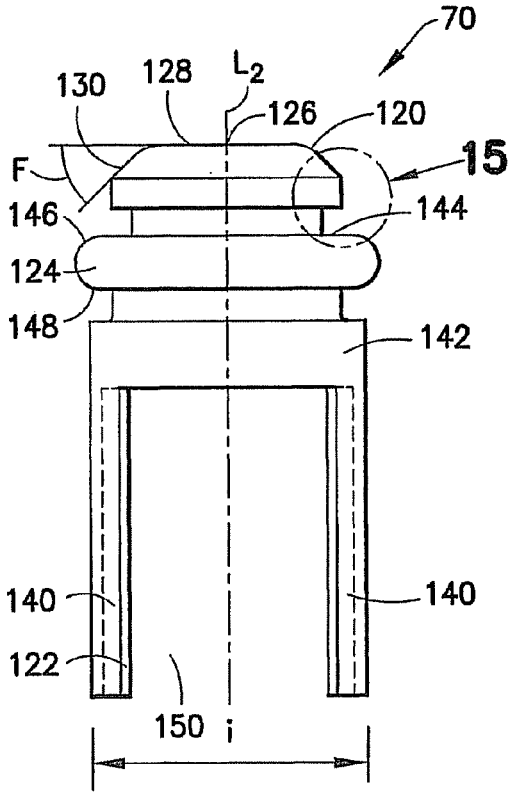
FIG. 15 is front view of the bellows structure of FIG. 2.
Figure 16:
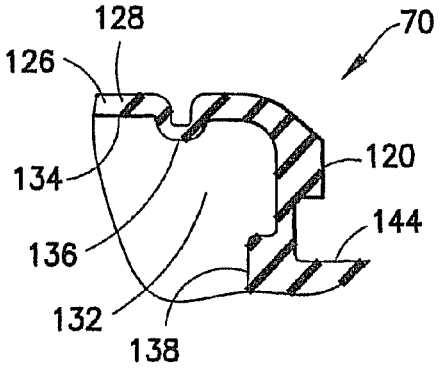
FIG. 16 is a close-up cross-sectional view of the bellows structure of FIG. 2 taken along section XV of FIG. 15.
Figure 17:
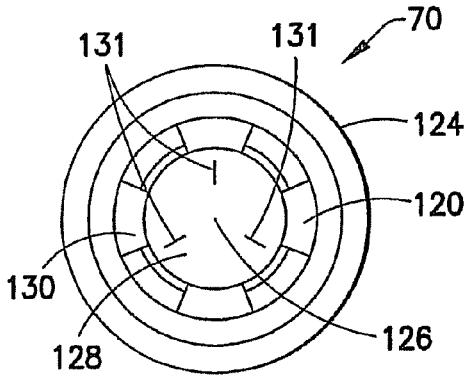
FIG. 17 is a top view of the bellows structure of FIG. 2.
Figure 25:
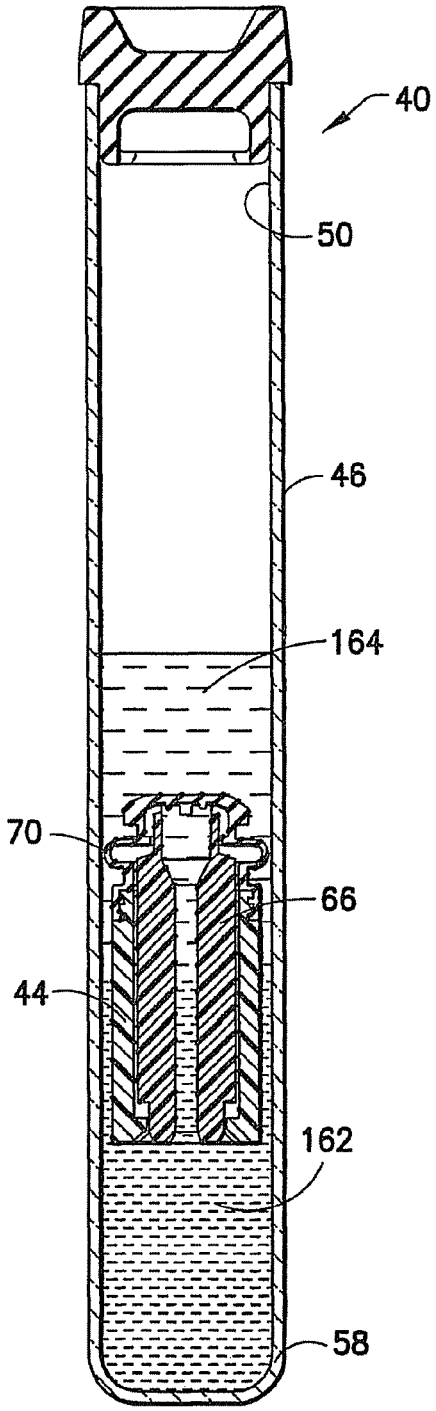
FIG. 25 is a cross-sectional front view of the assembly of FIG. 24 having the mechanical separator separating the less dense portion of the fluid from the denser portion of the fluid in accordance with an embodiment of the present invention.
Figure 26:
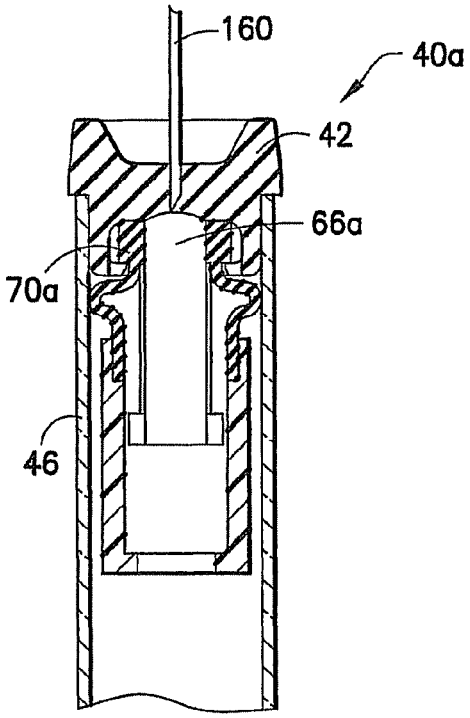
FIG. 26 is a cross-sectional front view of an assembly having a mechanical separator and a closure engaged within a tube showing the needle contacting the float structure in accordance with an embodiment of the present invention.

As shown in the close-up cross-section view of FIG. 16 taken along section XV of FIG. 15, the upper first end 120 of the bellows structure 70 defines an interior 132, and an interior surface 134 of the upper first end 120 adjacent the pierceable head portion 126 includes an interior engagement portion 136 extending into the interior 132 of the upper first end 120. In one embodiment, the interior engagement portion 136 is structured to engage the interior diameter of the float 66. The engagement of the interior engagement portion 136 of the bellows structure 70 and the interior diameter of the float, shown in FIG. 8, provides reinforcing structure to the pierceable head portion 126 of the bellows structure 70. In one embodiment, the perimeter 92 of the float 66, shown in FIGS. 6-9 substantially corresponds to the puncture profile of the pierceable head portion 126 of the bellows structure 70. Therefore, the upper first end 120 of the bellows structure 70 may include a pierceable head portion 126 having a puncture profile structured to substantially resist deformation upon application of a puncture tip, as shown in FIGS. 25-26, therethrough. The corresponding profiles of the pierceable head portion 126 of the bellows structure 70 and the head portion 80 of the float 66 make the pierceable head portion 126 of the present invention more stable and less likely to "tent" than the pierceable region of existing mechanical separators. To further assist in limiting sample pooling and premature release of the separator 44 from the bottom recess 62 of the closure 42, the flat portion 128 of the pierceable head portion 126 may optionally include a thickened region, such as from about 0.02 inch to about 0.08 inch thicker than other portions of upper first end 120 of the bellows structure 70. In this manner, prelaunch of the mechanical separator 44 is further minimized by the precompression of the pierceable head against the interior of the closure 42.

Referring again to FIGS. 14-17, the interior surface 134 of the upper first end 120 of the bellows structure 70 also includes an interior flange 138 extending into the interior 132 and positioned between the pierceable head portion 126 and the deformable bellows 124. The interior flange 138 may retain in releaseable attachment at least a portion of the float 66, shown in FIGS. 5-9, within the interior 132 of the bellows structure 70. In another embodiment, the interior flange 138 may releasably retain at least a portion of the float 66, again shown in FIGS. 5-9, within the interior 132 of the upper first end 120 of the bellows structure 70 by mechanical interface. The attached float 66, shown in FIGS. 5-9, and upper first end 120 of the bellows structure 70 provides a releaseable interference engagement therebetween for maintaining the float 66 in fixed relation with respect to the bellows structure 70. In one embodiment, the neck portion 82 of the float 66 and the interior flange 138 of the bellows structure 70 retain the float 66 in mechanical interface with the bellows structure 70.

Figure 14:
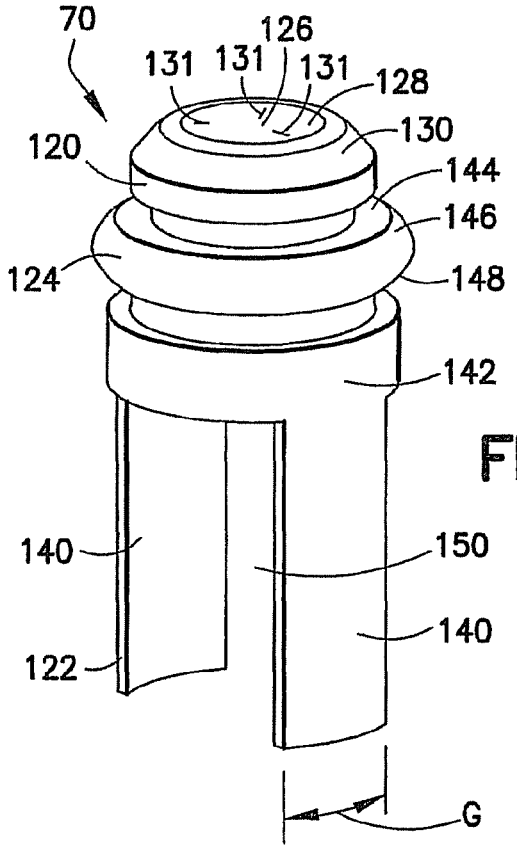
FIG. 14 is a perspective view of the bellows structure of FIG. 2.

Referring to FIGS. 14-15, the deformable bellows 124 is spaced longitudinally apart from the upper first end 120 of the bellows structure 70. The deformable bellows 124 may be located adjacent the interior flange 138 but extending laterally outward from an exterior surface 144 of the bellows structure 70. The deformable bellows 124 is symmetrical about a longitudinal axis $L_2$, and includes an upper end 146, a lower end 148, and a hollow interior extending therebetween. The deformable bellows 124 provides for sealing engagement of the bellows structure 70 with the cylindrical sidewall 52 of the tube 46, as shown in FIG. 2. The deformable bellows 124 can be made of any sufficiently elastomeric material sufficient to form a liquid impermeable seal with the cylindrical sidewall 52 of the tube 46. In one embodiment, the bellows is thermoplastic elastomer and has an approximate dimensional thickness of from about 0.015 inch to about 0.025 inch. In another embodiment, the entire bellows structure 70 is made of thermoplastic elastomer.

The deformable bellows 124 may have a generally torodial shape having an outside diameter "i" which, in an unbiased position, slightly exceeds the inside diameter "a" of the tube 46, shown in FIG. 2. However, oppositely directed forces on the upper end 146 and the lower end 148 will lengthen the deformable bellows 124, simultaneously reducing the outer diameter "i" to a dimension less than "a".

As shown in FIGS. 14-15, the lower second end 122 of the bellows structure 70 includes opposed depending portions 140 extending longitudinally downward from the upper first end 120. In one embodiment, the opposed depending portions 140 are connected to a lower end ring 142 extending circumferentially about the bellows structure 70. In one embodiment, the opposed depending portions 140 define a receiving space 150 structured to receive a portion of the ballast assembly 68 therein. In one embodiment, the opposed depending portions 140 define opposed receiving spaces 150. A first ballast portion 98 is structured for receipt and attachment within a first receiving space 150 and the second ballast portion 100 is structured for receipt and attachment within a second receiving space 150. In one embodiment, the depending portions 140 have an exterior curvature G corresponding to the exterior curvature of the first ballast portion 98 and the second ballast portion 100. Depending portions 140 of the bellows 70 may also be designed to be molded to the ballast assembly 68, such as by two-shot molding techniques. This may allow for formation of a bond between the ballast assembly 68 and the bellows 70 along a surface of the depending portions 140. This may allow the ballast assembly 68 to flex open as the bellows 70 stretches, and to subsequently allow for the float 66 to be inserted into the ballast assembly 68.

As shown in FIGS. 18-21, when assembled, the mechanical separator 44 includes a bellows structure 70 having an upper first end 120, a lower second end 122, and a deformable bellows 124 therebetween. The float 66 is attached to a portion of the upper first end 120 of the bellows structure 70 and the ballast assembly 68, including the first ballast portion 98 and the second ballast portion 100, is attached to the second lower end 122 of the bellows structure 70. The first ballast portion 98 and the second ballast portion 100 may be joined through a portion of the bellows structure 70, such as joined through a depending portion 140.

Figure 21:
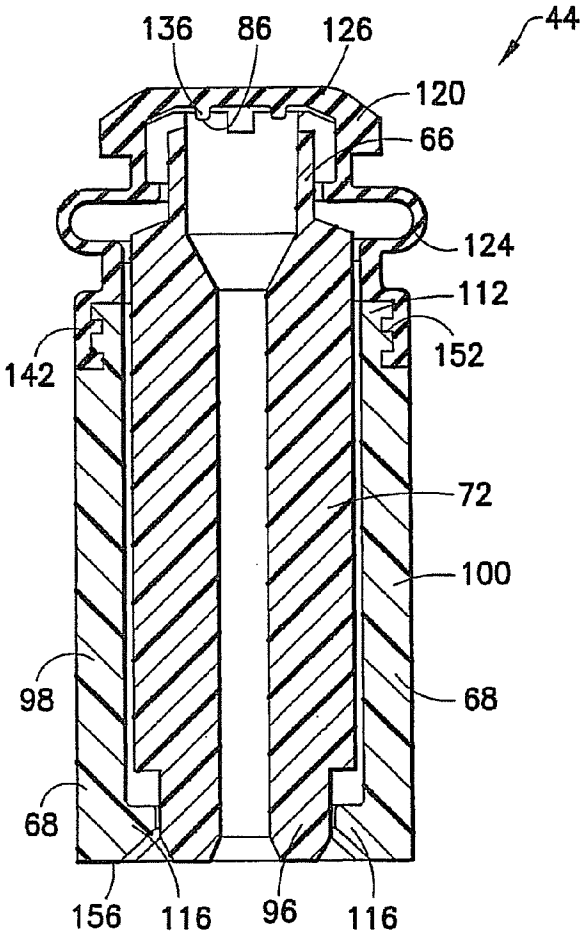
FIG. 21 is a cross-sectional view of the mechanical separator of FIG. 18 taken along line 21-21 of FIG. 20.
Figure 20:
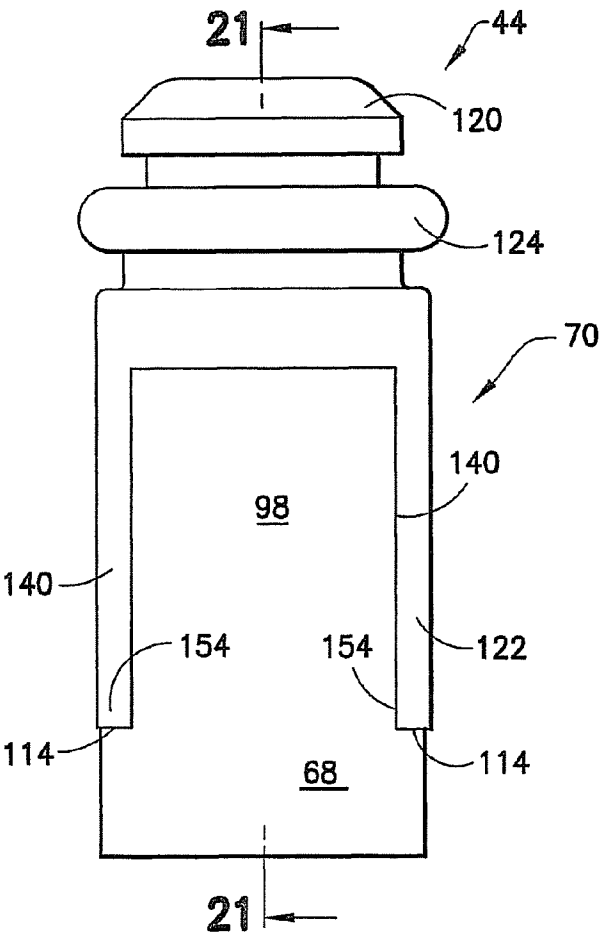
FIG. 20 is a front view of the mechanical separator of FIG. 18.

As shown in FIG. 21, in one embodiment, the receiving recess 112 of the first ballast portion 98 may be mechanically engaged with a corresponding protrusion 152 of the lower end ring 142 of the bellows structure 70. Likewise, the corresponding receiving recess 112 of the second ballast portion 100 may be mechanically engaged with a corresponding protrusion 152 of the lower end ring. As shown in FIG. 20, the second receiving recess 114 of the first ballast portion 98 may also be mechanically engaged with the lower tip 154 of the depending portion 140 of the bellows structure 70. Therefore, the first ballast portion 98, the second ballast portion 100, and the opposing depending portions 140 of the bellows structure 70 form a cylindrical exterior having a diameter "j" that is less than the diameter "a" of the interior of the tube 46, shown in FIG. 2.

In this configuration, the float 66 provides reinforcing support to the pierceable head portion 126 of the bellows structure 70 to minimize deformation and tenting. The float 66 is restrained within the interior 132 of the bellows structure 70 by the mechanical interface of the interior flange 138 of the bellows structure 70 with the neck portion 82 of the float 66.

As shown in FIG. 19, the assembled mechanical separator 44 may be urged into the bottom recess 62 of the closure 42. This insertion engages the flanges 64 of the closure 42 with the upper end 120 of the bellows structure 70. During insertion, at least a portion of the upper end 120 of the bellows structure 70 will deform to accommodate the contours of the closure 42. In one embodiment, the closure 42 is not substantially deformed during insertion of the mechanical separator 44 into the bottom recess 62. In one embodiment, the mechanical separator 44 is engaged with the closure 42 by an interference fit of the pierceable head portion 126 of the upper end 120 of the bellows structure 70 and the bottom recess 62 of the closure 42. Optionally, a detent ring (not shown) may be employed at the upper end 120 of the bellows structure 70 to further secure the mechanical separator 44 within the closure 42.

Referring again to FIG. 21, in use, the float 66 of the mechanical separator 44 is intended to be restrained within the interior 132 of the bellows structure 70 by the mechanical interface of the interior flange 138 of the bellows structure 70 with the neck portion 82 of the float 66 until the mechanical separator is subjected to accelerated centrifugal forces, such as within a centrifuge. The presence of the float 66 prevents the top portion of the bellows structure 70 from deforming and thus prevents the mechanical separator 44 from releasing from the closure 42. The mechanical separator 44 is "locked" within the closure 42 until sufficient g-load is generated during centrifugation to pull the float 66 free of the bellows 70, and release the mechanical separator 44 from the closure 42.

Upon application of accelerated centrifugal forces, the bellows structure 70, particularly the deformable bellows 124, are adapted to longitudinally deform due to the force exerted on the ballast 68. The ballast 68 exerts a force on the bellows 70 as a result of the g-load during centrifugation. The interior flange 138 is longitudinally deflected due to the force exerted upon it by the float 66, thereby allowing the neck portion 82 of the float 66 to release. When the float 66 is released from the bellows structure 70, it may be free to move within the mechanical separator 44. However, at least a portion of the float 66 may be restrained from passing though a lower end 156 of the mechanical separator 44 by contact with the interior restraint 116 of the first ballast portion 98 and the interior restraint 116 of the second ballast portion 100. In one embodiment, the graduated portion 96 of the float 66 may pass through the lower end 156 of the mechanical separator 44, however, the tubular body 72 of the float is restrained within the interior of the mechanical separator 44 by the interior restraint 116 of the first ballast portion 98 and the interior restraint 116 of the second ballast portion 100. After the mechanical separator 44 has been released from the closure 42, the mechanical separator 44 travels toward the fluid interface within the tube 46. Once the mechanical separator 44 enters into the fluid contained within the tube 46, the float 66 travels back up and is affixed in the bellows 70.

In one embodiment, the ballast assembly 68 and the bellows structure 70 can be co-molded or co-extruded as a sub-assembly, such as by two-shot molding. The sub-assembly may include the ballast assembly at least partially disposed about the bellows structure 70 including a pierceable head portion 126. In another embodiment, the ballast assembly 68 and the bellows structure 70 can be co-molded or co-extruded, such as by two-shot molding, into a portion of the closure 42, as shown in FIG. 19. Co-molding the ballast assembly 68 and the bellows structure 70 reduces the number of fabrication steps required to produce the mechanical separator 44. Alternatively, the ballast assembly 68 and the bellows structure 70 can be co-molded or co-extruded, such as by two-shot molding, and subsequently inserted into the closure 42. The float 66 may then be inserted separately into the sub-assembly to bias the mechanical interface between the bellows structure 70 and the closure 42. Alternatively, the float 66 may be inserted into the sub-assembly and the combined float and sub-assembly may then be inserted into the closure 42.

Figure 22:
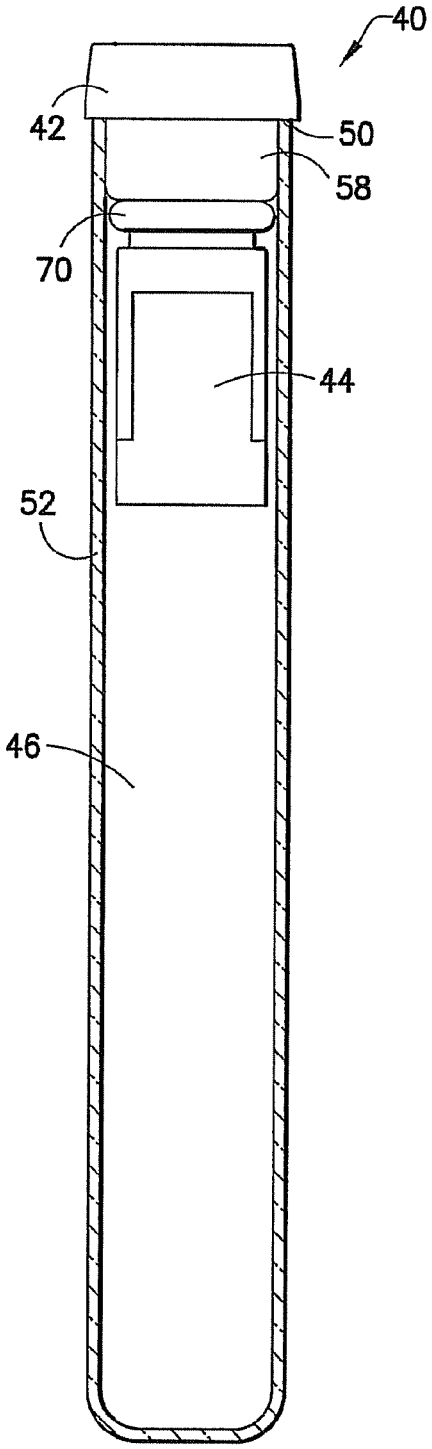
FIG. 22 is a front view of an assembly including a tube having a closure and a mechanical separator disposed therein in accordance with an embodiment of the present invention.
Figure 23:
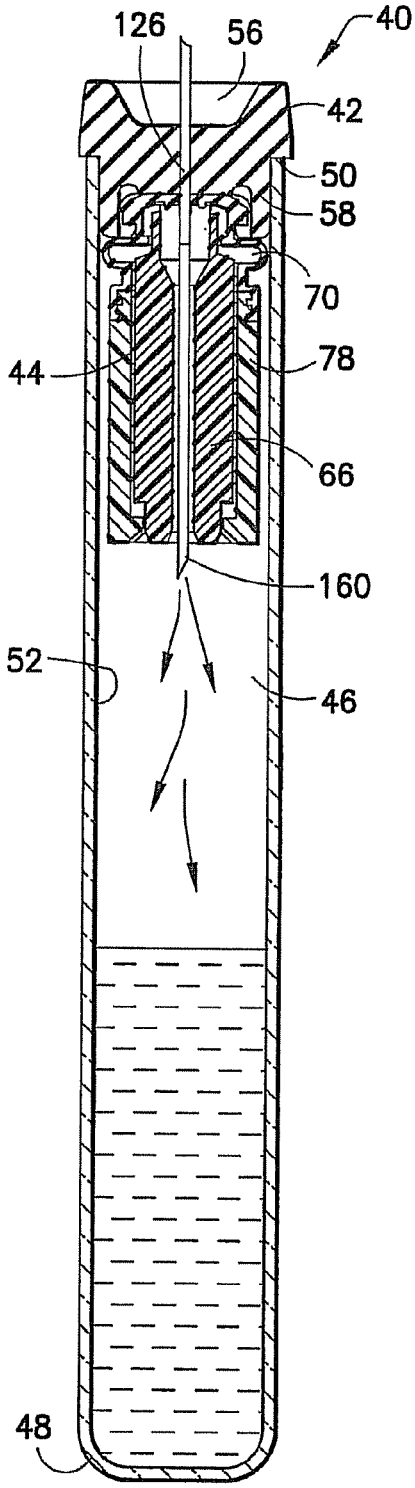
FIG. 23 is a cross-sectional front view of the assembly of FIG. 22 having a needle accessing the interior of the tube and an amount of fluid provided through the needle into the interior of the tube in accordance with an embodiment of the present invention.

As shown in FIGS. 22-23, the mechanical separation assembly 40 includes a mechanical separator 44 and a closure 42 inserted into the open top end 50 of the tube 46, such that the mechanical separator 44 and the bottom end 58 of the closure 42 lie within the tube 46. Optionally, the closure 42 may be at least partially surrounded by a shield, such as a Hemogard® Shield commercially available from Becton, Dickinson and Company, to shield the user from droplets of blood in the closure 42 and from potential blood aerosolisation effects when the closure 42 is removed from the tube 46, as is known. During insertion, the mechanical separator 44, including the bellows structure 70, will sealingly engage the interior of the cylindrical sidewall 52 and the open top end of the tube 46.

As shown in FIG. 23, a liquid sample is delivered to the tube 46 by the puncture tip 160 that penetrates the septum of the top end 56 of the closure 42 and the pierceable head portion 126 of the bellows structure 70. For purposes of illustration only, the liquid is blood. Blood will flow through the central passage 78 of the float 66 and to the closed bottom end 48 of the tube 46. The puncture tip 160 will then be withdrawn from the assembly. Upon removal of the puncture tip 160, the closure 42 will reseal itself. The pierceable head portion 126 will also reseal itself in a manner that is substantially impervious to fluid flow.

Figure 24:
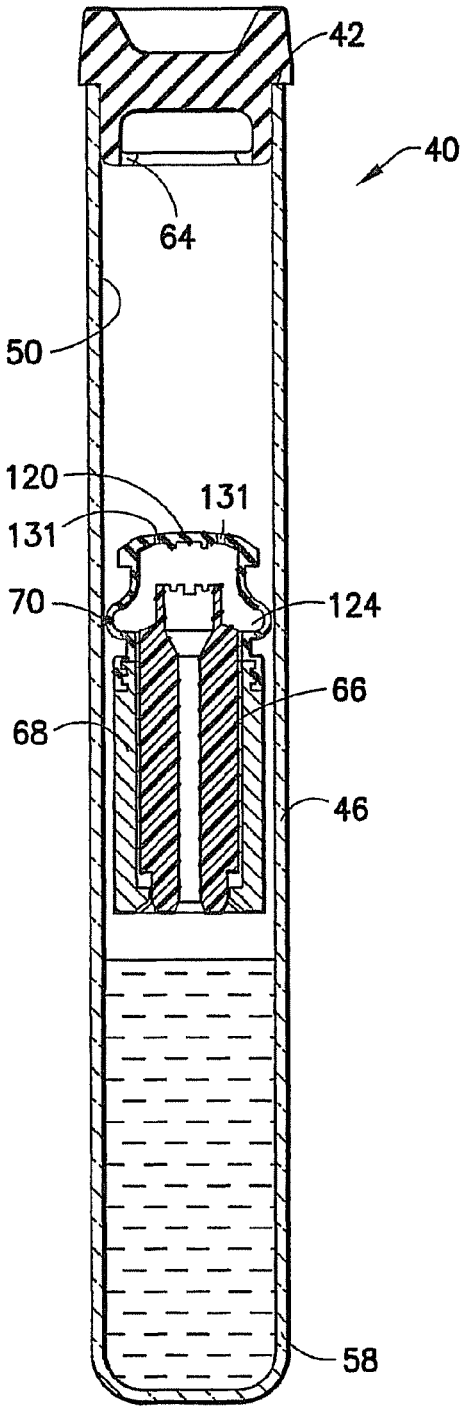
FIG. 24 is a cross-sectional front view of the assembly of FIG. 23 having the needle removed therefrom during use, and the mechanical separator positioned apart from the closure in accordance with an embodiment of the present invention.

As shown in FIG. 24, when the mechanical separation assembly 40 is subjected to an applied rotational force, such as centrifugation, the respective phases of the blood will begin to separate into a denser phase displaced toward the closed bottom end 58 of the tube 46, and a less dense phase displaced toward the top open end 50 of the tube 46.

In one embodiment, the mechanical separation assembly 40 is adapted such that when subjected to applied centrifugal force, the float 66 releases from the engagement with the bellows structure 70 prior to the bellows structure 70 releasing from the bottom recess 62 of the closure 42. Accordingly, the interior flange 138 of the bellows structure 70, shown in FIG. 16, may deform sufficiently to allow at least a portion of the float 66 to release from the bellows structure 70 while the bellows structure 70 is engaged within the bottom recess 62 of the closure 42. The releaseable interference engagement of the float 66 and the bellows structure 70 may be adapted to release the float 66 from the bellows structure 70 when the mechanical separation assembly 40 is subjected to centrifugal forces in excess of a centrifugation threshold. In one embodiment, the centrifugation threshold is at least 250 g. In another embodiment, the centrifugation threshold is at least 300 g. Once the mechanical separation assembly 40 is subjected to an applied centrifugal force in excess of the centrifugation threshold, and the releaseable interference engagement of the float 66 and the bellows structure 70 is disengaged, the mechanical separation assembly 40 may disengage, such as release abutting engagement, from within the bottom recess 62 of the closure 42, as shown in FIG. 24. Optionally, the release of the float 66 from the bellows structure 70 enables the mechanical separation assembly 40 to release from the bottom recess 62 of the closure 42.

Figure 6:
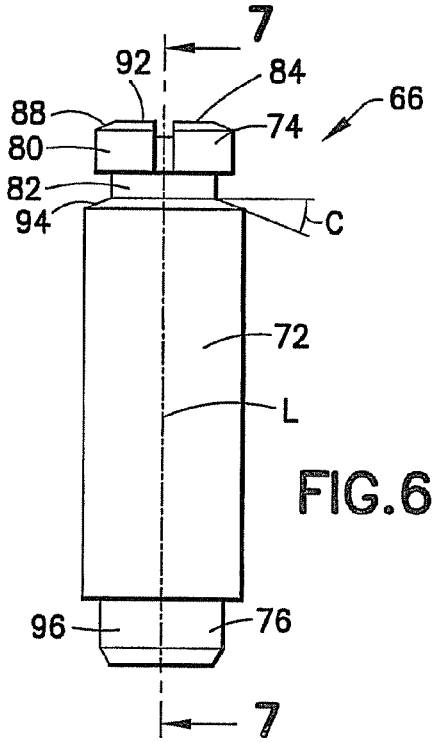
FIG. 6 is a front view of the float of FIG. 2.
Figure 7:
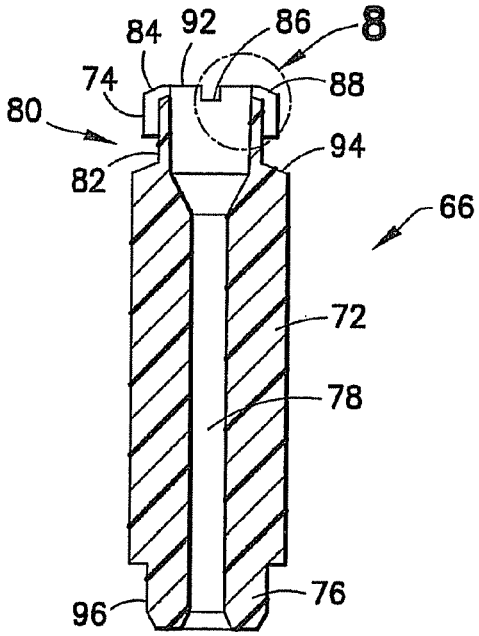
FIG. 7 is a cross-sectional view of the float of FIG. 2 taken along line 7-7 of FIG. 6.

The mechanical separation assembly 40 is adapted to be retained within the bottom recess of the closure during pre-launch procedures, such as during insertion of a non-patient needle through the pierceable head portion 126 of the bellows structure 70. In another embodiment, the mechanical separation assembly 40 is also adapted such that the float 66 is retained in releaseable interference engagement with the bellows structure 70 during insertion of a non-patient needle through the pierceable head portion 126 of the bellows structure 70. Accordingly, the releaseable interference engagement of the float 66 and the bellows structure 70 is sufficient to resist an axial pre-launch force applied substantially along the longitudinal axis L of the float 66, as shown in FIG. 6, and/or substantially along the longitudinal axis $L_2$ of the bellows structure 70, as shown in FIG. 15. The releaseable interference engagement of the float 66 and the bellows structure 70 may be sufficient to resist at least 0.5 lbf. In another embodiment, the releaseable interference engagement of the float 66 and the bellows structure 70 may be sufficient to resist at least 2.5 lbf. The releaseable interference engagement of the float 66 and the bellows structure 70 of the mechanical separation assembly 40 is therefore sufficient to maintain the engagement of the float 66 and the bellows structure 70 with each other, and the mechanical separation assembly 40 within the bottom recess 62 of the closure 42, during insertion of a non-patient needle through the pierceable head portion 126 of the bellows structure 70. The releasable interference engagement of the float 66 and the bellows structure 70 is also adapted to disengage the float 66 from the bellows structure 70, and the mechanical separation assembly 40 from the bottom recess 62 of the closure 42 upon applied centrifugal force in excess of the centrifugation threshold.

During use, the applied centrifugal force will urge the ballast assembly 68 of the mechanical separator 44 toward the closed bottom end 58 of the tube 46. The float 66 is only urged toward the top end 50 of the tube 46 after the mechanical separator 44 has been released from the closure 42 and the mechanical separator is immersed in fluid. When the mechanical separator 44 is still affixed to the closure 42, both the float 66 and the ballast assembly 68 experience a force that acts to pull them towards the bottom end of the tube 46. Accordingly, the ballast assembly 68 is longitudinally moveable with respect to the float 66. This longitudinal movement generates a longitudinal deformation of the bellows structure 70. As a result, the bellows structure 70, and particularly the deformable bellows 124, will become longer and narrower and will be spaced concentrically inward from the inner surface of the cylindrical sidewall 52. The force exerted by the float 66 on the interior flange 138 of the bellows structure 70 deflects the bellows structure 70, and as such, the neck portion of the float 66 is released. As the float 66 is disengaged from the interior flange 138 of the bellows structure 70, the upper end 120 of the bellows structure 70 is resiliently deformable in the longitudinal direction during applied centrifugal force. Accordingly, the upper end 120 of the bellows structure 70 will disengage from the closure 42. In one embodiment, the closure 42, particularly the flanges 64, are not dimensionally altered by the application of applied centrifugal force and, as a consequence, do not deform.

As shown in FIG. 24, in one embodiment, the negative buoyancy of the ballast assembly 68 opposes the positive buoyancy of the float 66 creating a differential force which causes the bellows structure 70 to contract away from the interior surface of the sidewall of the tube 46. This elongation of the bellows structure 70 causes the venting slits 131 to open under load. Once the venting slits 131 are opened, air trapped within the mechanical separation assembly 40 may be vented through the venting slits 131 into the tube at a location above the mechanical separation assembly 40. After centrifugation, the bellows structure 70 resiliently returns to the undeformed position and the venting slits 131 re-seal to the closed position.

The present design reduces pre-launch by preventing the mechanical separator 44 from detaching from the closure 42 as a result of the interaction of the needle with the head of the bellows structure 70. The mechanical separator 44 cannot separate from the closure 42 until the float 66 is launched during centrifugation. In addition, the structure of the closure 42 creates a pre-load on a target area of the bellows structure 70, which helps to minimize bellows-tenting.

As the mechanical separator 44 is disengaged from the closure 42 and the diameter of the deformable bellows 124 is lessened, the lighter phase components of the blood will be able to slide past the deformable bellows 124 and travel upwards, and likewise, heavier phase components of the blood will be able to slide past the deformable bellows 124 and travel downwards. As noted above, the mechanical separator 44 has an overall density between the densities of the separated phases of the blood.

Consequently, as shown in FIG. 25, the mechanical separator 44 will stabilize in a position within the tube 46 of the mechanical separation device 40 such that the heavier phase components 162 will be located between the mechanical separator 44 and the closed bottom end 58 of the tube 46, while the lighter phase components 164 will be located between the mechanical separator 44 and the top end of the tube 50. After this stabilized state has been reached, the centrifuge will be stopped and the deformable bellows 124 will resiliently return to its unbiased state and into sealing engagement with the interior of the cylindrical sidewall 52 of the tube 46. The formed liquid phases may then be accessed separately for analysis.

Figure 27:
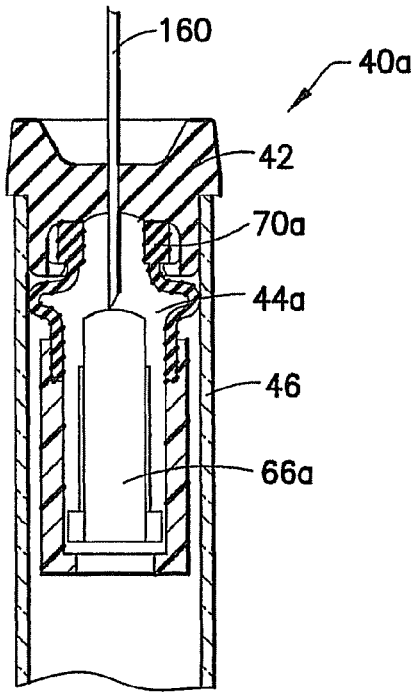
FIG. 27 is a cross-sectional view of the assembly of FIG. 26 showing the needle disengaging the float from the bellows structure in accordance with an embodiment of the present invention.
Figure 28:
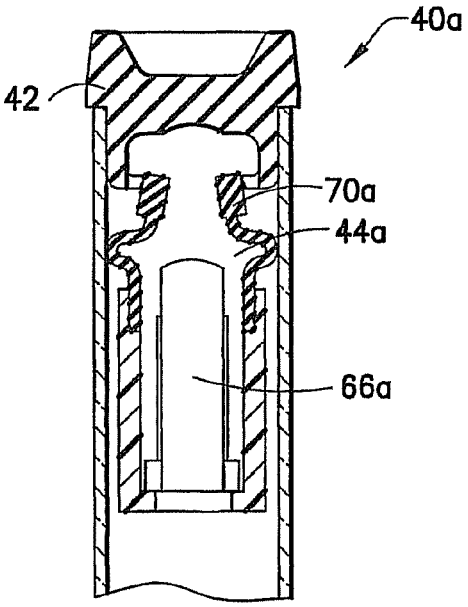
FIG. 28 is a cross-sectional view of the assembly of FIG. 27 showing the float disengaged from the bellows structure and the ballast assembly being directed in a downward orientation in accordance with an embodiment of the present invention.
Figure 29:
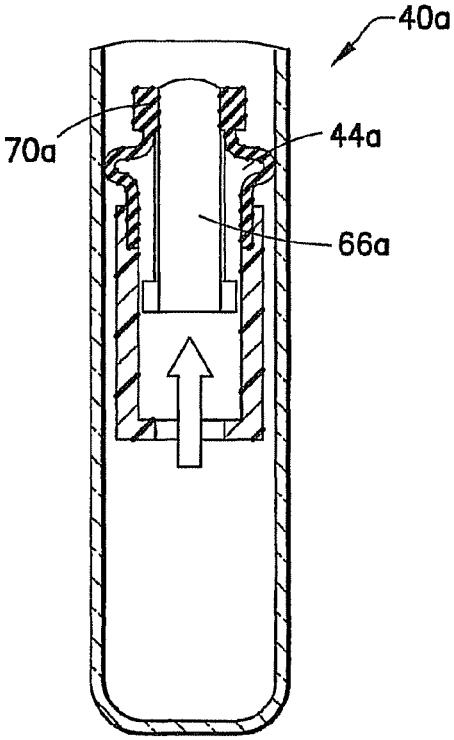
FIG. 29 is a cross-sectional view of the assembly of FIG. 27 showing the float re-directed upwards into the mechanical separator in accordance with an embodiment of the present invention.

In an alternative embodiment, shown in FIGS. 26-29, the application of the puncture tip 160 through the closure 42 of the mechanical separation assembly **40*a* directly contacts the float 66*a*. In this embodiment, the bellows structure 70*a* can be oriented to circumferentially surround a portion of the float 66*a* to provide sealing engagement with the closure 42 and sidewall of the tube 46. As shown in FIG. 27, the force of the puncture tip 160 disengages the releaseable interference engagement between the float 66*a* and the bellows structure 70*a*, as previously described above, thereby allowing liquid, such as blood, to fill in the mechanical separator 44*a* around the float 66*a*. As shown in FIG. 28, with the float 66*a* ejected from the bellows structure 70*a*, the mechanical separator 44*a* is free to launch from the closure 42 during accelerated rotation, such as centrifugation. As shown in FIG. 29, once the mechanical separator 44*a* is disengaged from the closure, the natural buoyancy of the float 66*a* urges the float 66*a* back into the bellows structure 70*a* as soon as the mechanical separator 44*a*** enters the liquid within the tube.

Figure 30:
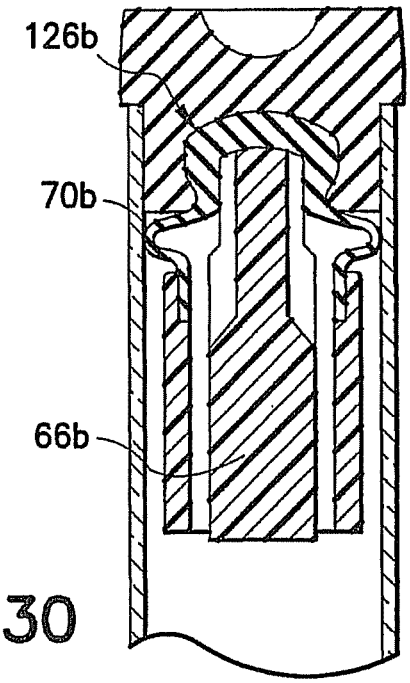
FIG. 30 is a cross-sectional view of an assembly having a mechanical separator and a closure engaged within a tube in accordance with an embodiment of the present invention.
Figure 31:
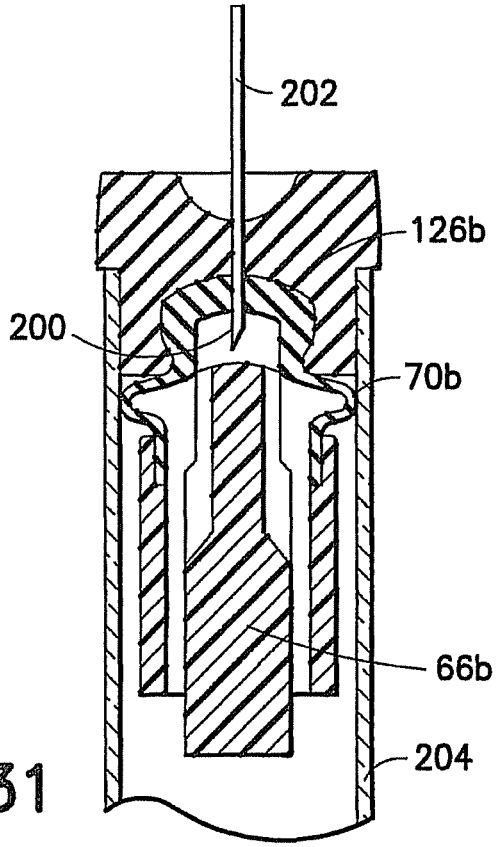
FIG. 31 is cross-sectional view of the assembly of FIG. 30 showing the needle piercing the mechanical separator in accordance with an embodiment of the present invention.

In yet another alternative embodiment show in FIGS. 30-31, similar to the description of FIGS. 26-29, the bellows structure 70*b* can include a pierceable head portion 126*b*, similar to the configuration previously described, with the exception that the pierceable head portion 126*b* has a thickness sufficient to allow the entire puncture tip 200 of the needle 202 to be buried within the pierceable head portion 126*b* before contacting the float 66*b*. By allowing the puncture tip 200 to be entirely buried within the pierceable head portion 126*b*, bellows-tenting or pooling of sample within the deformed bellows is minimized. The float 66*b* may be made of a solid, rigid material. As the needle 202 is advanced further, the float 66*b* is displaced, allowing the liquid, such as blood, to flow around the float 66*b* and into the tube 204. During centrifugation, the float 66*b* will reengage the bellows 70*b*.

Figure 32:
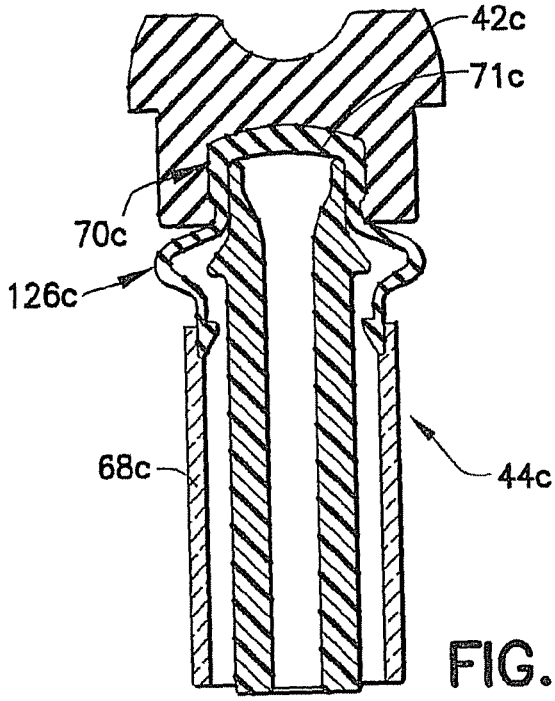
FIG. 32 is a cross-sectional view of an assembly having a mechanical separator and a closure engaged within a tube in accordance with an embodiment of the present invention.
Figure 33:
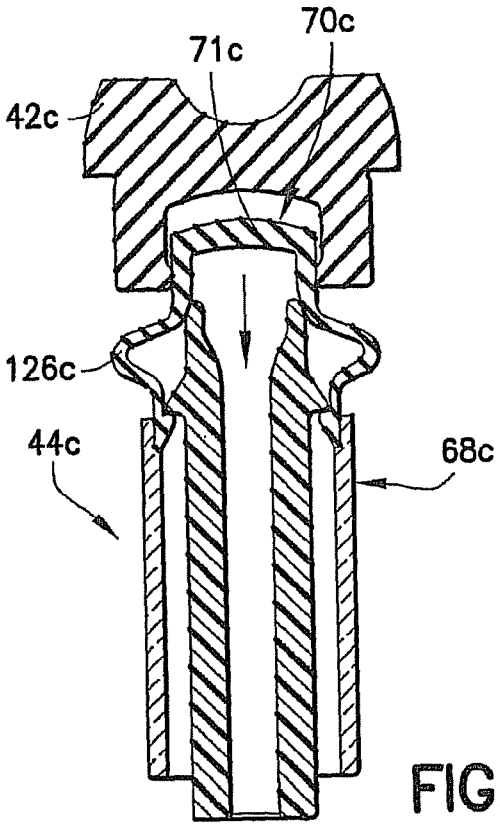
FIG. 33 is a cross-sectional view of the assembly of FIG. 32 showing the mechanical separator partially displaced from the closure.

In yet another embodiment, as shown in FIGS. 32-33, similar to the description of FIGS. 26-29, the bellows assembly 70*c* may include a pierceable head portion 126*c* having a thickened target area 71*c* to resist tenting or deformation upon application of a puncture tip (not shown) therethrough. By minimizing the effects of bellows-tenting, premature disengagement of the mechanical separator from the closure is also minimized. Accordingly, the application of centrifugal force, and not the engagement of the puncture tip with the mechanical separator, causes the ballast assembly 68*c* to move longitudinally, allowing the mechanical separator 44*c* to release from the closure 42*c*. Optimally, a detent ring may be positioned about the bellows assembly 70*c* adjacent the closure 42*c* to secure the mechanical separator 44*c* in place.

Figure 34:
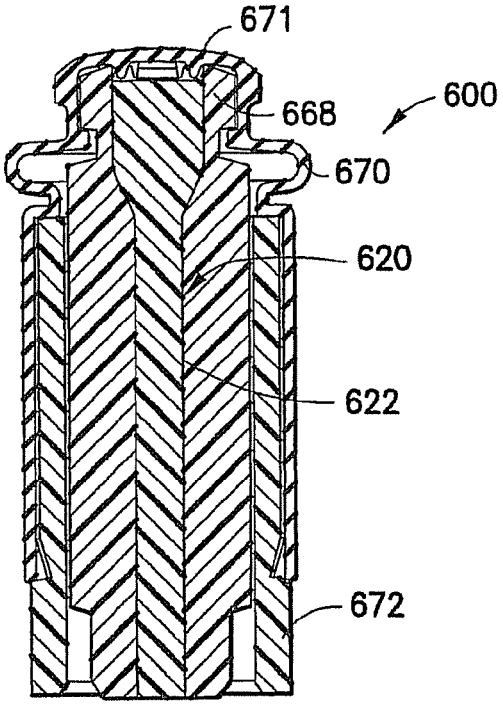
FIG. 34 is a partial cross-sectional view of a mechanical separator having a moveable plug disposed within the float in accordance with an embodiment of the present invention.

In accordance with yet another embodiment of the present invention, shown in FIG. 34, a mechanical separator 600 may include a float 668, a bellows 670, and a ballast 672 as described herein. In one configuration, the float 668 may be provided with a moveable plug 620 disposed within an interior portion 622 of the float 668. In one embodiment, the moveable plug 620 may be formed from the same material as the float 668, and in another embodiment, the moveable plug 620 may be formed from a material having substantially the same density as the density of the float 668. In yet another embodiment, the moveable plug 620 may be inserted within an interior portion 622 of the float 668 after formation of the float 668.

Figure 34A:
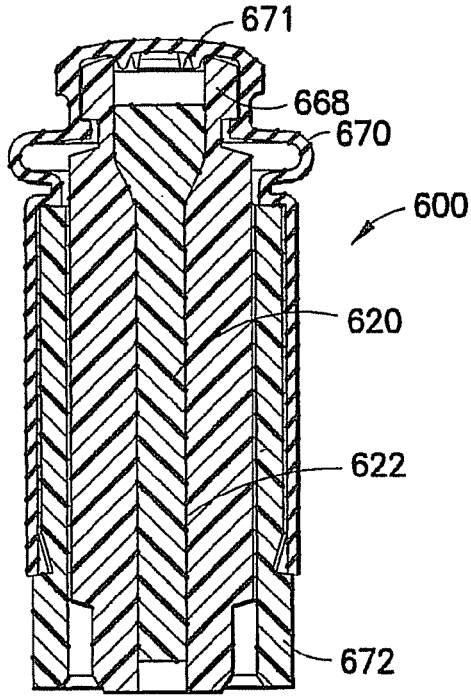
FIG. 34A is a partial cross-sectional view of the mechanical separator of FIG. 34 in an initial position.

In certain situations, a mechanical separator 600 including a float 668 having a moveable plug 620 may be advantageous. For example, certain testing procedures require that a sample be deposited into a specimen collection container and that the specimen collection container be subjected to centrifugal force in order to separate the lighter and heavier phases within the sample, as described herein. Once the sample has been separated, the specimen collection container and sample disposed therein may be frozen, such as at temperatures of about −70° C., and subsequently thawed. During the freezing process, the heavier phase of the sample may expand forcing a column of sample to advance upwardly in the specimen collection container and through a portion of the interior portion 622 of the float 668 thereby interfering with the barrier disposed between the lighter and heavier phases. In order to minimize this volumetric expansion effect, a moveable plug 620 may be provided within the interior portion 622 of the float 668, as shown in FIG. 34A.

Figure 34B:
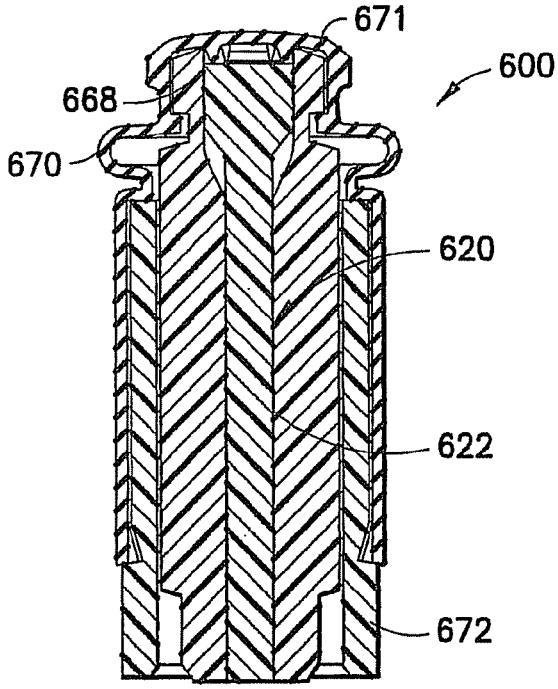
FIG. 34B is a partial cross-sectional view of the mechanical separator of FIG. 34A in a displaced position.

Once the sample is separated into lighter and denser phases within the specimen collection container (not shown) the sample may be frozen. During the freezing process, the denser portion of the sample may expand upwardly. In order to prevent the upwardly advanced denser portion of the sample from interfering with the lighter phase, and to prevent the denser portion of the sample from escaping the float 668, the moveable plug 620 advances upwardly with the expansion of the denser phase of the sample, as shown in FIG. 34B.

Figure 34C:
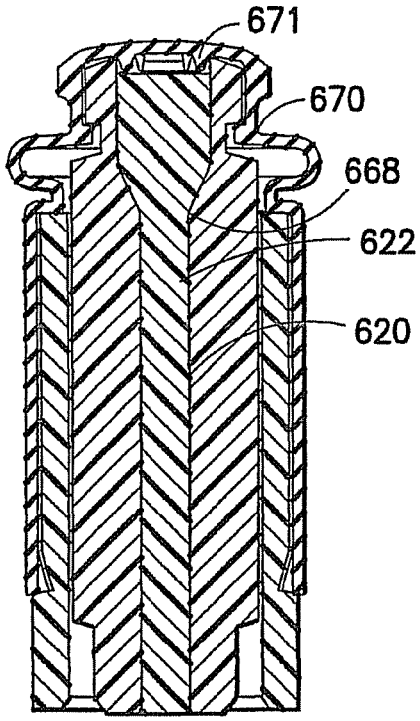
FIG. 34C is a partial cross-sectional view of an alternative mechanical separator having a moveable plug disposed within the float in accordance with an embodiment of the present invention in an initial position.
Figure 34D:
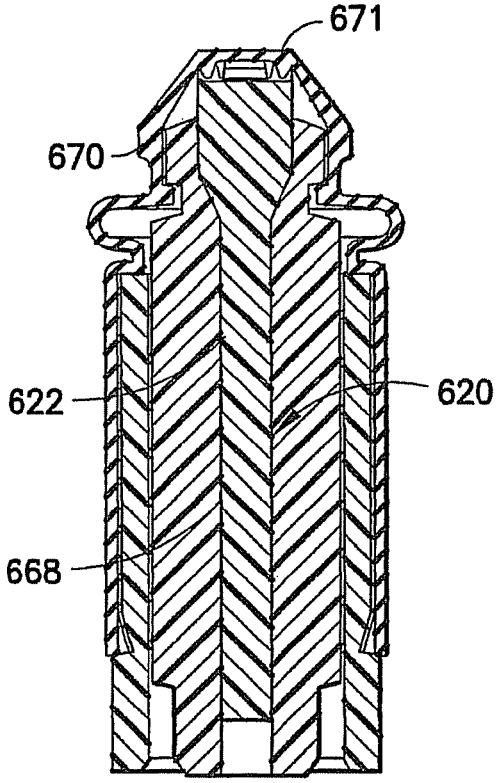
FIG. 34D is a partial cross-sectional view of the mechanical separator of FIG. 34C in a displaced position.

The moveable plug 620 may be adapted to advance with the expanded column of denser material present within the interior portion 622 of the float 668 during freezing. It is anticipated herein, that the moveable plug 620 may be restrained at an upper limit by an upper portion 671 of the bellows 670, shown schematically in FIGS. 34C-34D. In this configuration, the elasticity of the upper portion 671 of the bellows 670 may act as a stretchable balloon to constrain the moveable plug 620 within the mechanical separator 600.

Figure 35:
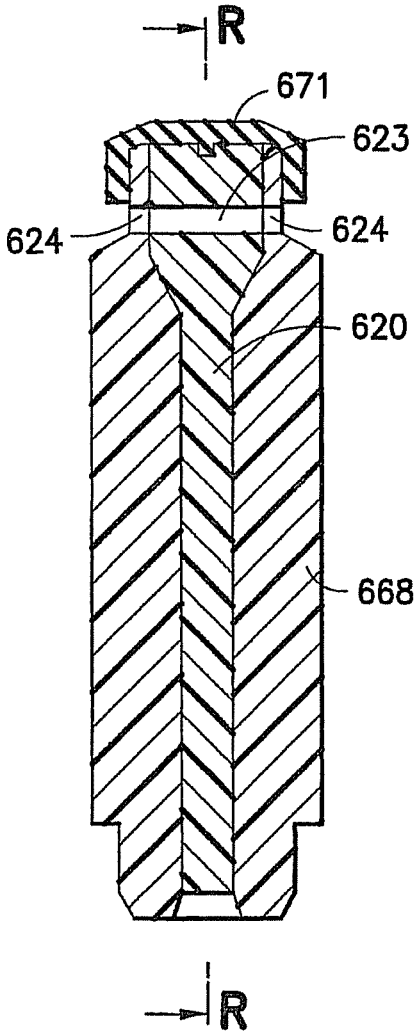
FIG. 35 is a cross-sectional front view of the float and moveable plug with a portion of the bellows of FIG. 34 in an initial position.
Figure 36:
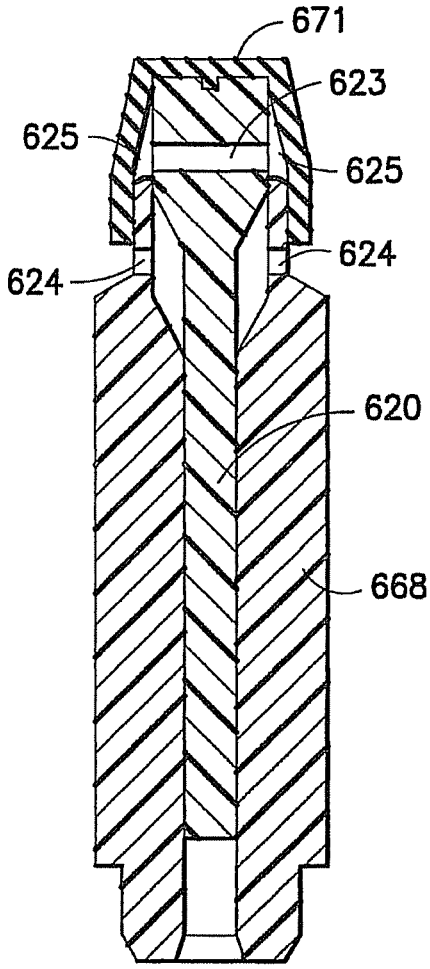
FIG. 36 is a cross-sectional front view of the float and moveable plug with a portion of the bellows of FIG. 35 in a displaced position.

In accordance with yet another embodiment, the moveable plug 620 may be provided with a transverse hole 623 which is substantially aligned with a transverse hole 624 provided in the float 668 in the initial position, shown in FIG. 35, and is substantially blocked by a blocking portion 625 of the float 668 in the displaced position, as shown in FIG. 36. In one embodiment, the transverse hole 624 of the moveable plug 620 is disposed substantially perpendicular to a longitudinal axis R of the moveable plug 668.

In this configuration, after sampling and during application of centrifugal force to the mechanical separator, air trapped within the interior portion 622 of the float 668 may be vented through the transverse hole 623 of the moveable plug and the transverse hole 624 of the float 668 and released from the mechanical separator 600. Specifically, air may be vented from between the float 668 and the bellows 670 as described herein. As the moveable plug 620 is upwardly advanced, the transverse hole 623 of the moveable plug 620 aligns with a blocking portion 625 of the float 668, which prevents sample from exiting the moveable plug 620 and interior portion 622 of the float 668 through the transverse hole 623.

The advancement of the moveable plug 620 may be entirely passive and responsive to the externally applied freezing conditions of the sample. In certain instances, the moveable plug 620 may also be provided to return to its initial position upon subsequent thawing of the sample.

Although the present invention has been described in terms of a mechanical separator disposed within the tube adjacent the open end, it is also contemplated herein that the mechanical separator may be located at the bottom of the tube, such as affixed to the bottom of the tube. This configuration can be particularly useful for plasma applications in which the blood sample does not clot, because the mechanical separator is able to travel up through the sample during centrifugation.

The mechanical separator of the present invention includes a float that is engaged or locked with a portion of the bellows structure until the separator is subjected to an applied centrifugal force. Thus, in use, the mechanical separator of the present invention minimizes device pre-launch and provides a more stable target area at the puncture tip interface to reduce sample pooling under the closure. Additionally, the reduced clearance between the exterior of the float and the interior of the ballast minimizes the loss of trapped fluid phases, such as serum and plasma.

While the present invention is described with reference to several distinct embodiments of a mechanical separator assembly and method of use, those skilled in the art may make modifications and alterations without departing from the scope and spirit. Accordingly, the above detailed description is intended to be illustrative rather than restrictive.

The invention claimed is:

1. A mechanical separator comprising:

a float;

a ballast assembly longitudinally moveable with respect to the float; and a bellows structure comprising a first end, a second end, and a deformable bellows therebetween, wherein the float is attached to a portion of the first end of the bellows structure, and the ballast assembly is attached to a portion of the second end of the bellows structure, the attached float and bellows structure further comprising a releasable interference engagement therebetween for maintaining the float in fixed relation with respect to the bellows structure, wherein the bellows structure defines an interior and the float is releasably retained within a portion of the interior of the bellows structure, and wherein the releasable interference engagement comprises an interior engagement portion of the bellows structure that extends into the interior and engages an interior portion of the float.

2. The mechanical separator of claim 1, wherein the float has a first density, and the ballast has a second density that is greater than the first density of the float.

3. The mechanical separator of claim 1, wherein the releasable interference engagement is adapted to release upon exceeding a centrifugation threshold.

4. The mechanical separator of claim 1, wherein the releasable interference engagement is configured to release upon the float exceeding a centrifugal force of at least 250 g.

5. The mechanical separator of claim 1, wherein the bellows structure comprises an interior flange, and at least a portion of the float is retained within the interior of the first end by the interior flange.

6. The mechanical separator of claim 5, wherein the float comprises a neck portion and the float is releasably retained within a portion of the interior of the first end by mechanical interference of the interior flange and the neck portion.

7. The mechanical separator of claim 1, wherein the first end comprises a pierceable head portion having a puncture profile structured to resist deformation upon application of a puncture tip therethrough.

8. The mechanical separator of claim 7, wherein the float comprises a head portion defining an opening and comprising a perimeter substantially corresponding to a portion of the puncture profile of the pierceable head portion.

9. The mechanical separator of claim 1, wherein the float comprises a head portion defining an opening therethrough to allow the venting of air from within an interior of the float to an area exterior of the mechanical separator.

10. The mechanical separator of claim 1, wherein the bellows structure comprises a venting slit to allow the venting of air from within an interior of the float to an area exterior of the mechanical separator.

11. The mechanical separator of claim 1, wherein the bellows structure comprises a venting slit to allow the venting of air from a chamber defined by an interior of the bellows structure and an exterior of the float to an area exterior of the mechanical separator.

12. The mechanical separator of claim 1, wherein the ballast assembly comprises a plurality of ballast sections.

13. The mechanical separator of claim 12, wherein the ballast assembly comprises a first ballast section and a second ballast section joined to the first ballast section through a portion of the bellows structure.

14. The mechanical separator of claim 13, wherein the first ballast section and the second ballast section are opposingly oriented about a longitudinal axis of the mechanical separator.

15. The mechanical separator of claim 1, wherein the float comprises polypropylene, the ballast assembly comprises polyethylene terephthalate, and the bellows structure comprises thermoplastic elastomer.

16. The mechanical separator of claim 1, further comprising a moveable plug moveably disposed within an interior of the float.

17. A mechanical separator comprising:

a bellows structure comprising a first end, a second end, and a deformable bellows therebetween;

a float; and a ballast assembly longitudinally moveable with respect to the float, the ballast assembly comprising a first ballast section and a second ballast section joined to the first ballast section through a portion of the bellows structure.

18. The mechanical separator of claim 17, wherein the float has a first density, and the ballast assembly has a second density that is greater than the first density of the float.

19. The mechanical separator of claim 17, wherein the float is attached to a portion of the first end of the bellows structure, and the ballast is attached to a portion of the second end of the bellows structure, the attached float and bellows structure further comprising a releasable interference engagement therebetween for maintaining the float in fixed relation with respect to the bellows structure.

20. The mechanical separator of claim 19, wherein the releasable interference engagement is adapted to release upon centrifugation.

21. The mechanical separator of claim 17, wherein the bellows structure defines an interior and the float is releasably retained within a portion of the interior of the bellows structure.

22. The mechanical separator of claim 17, wherein the first ballast section and the second ballast section are opposingly oriented about a longitudinal axis of the mechanical separator.

23. The mechanical separator of claim 17, wherein the float comprises a head portion defining an opening therethrough to allow the venting of air from within an interior of the float to an area exterior of the mechanical separator.

24. The mechanical separator of claim 17, wherein the bellows structure comprises a venting slit to allow the venting of air from within an interior of the float to an area exterior of the mechanical separator.

25. The mechanical separator of claim 17, wherein the bellows structure comprises a venting slit to allow the venting of air from a chamber defined by an interior of the bellows structure and an exterior of the float to an area exterior of the mechanical separator.

26. A separation assembly for enabling separation of a fluid sample into first and second phases, comprising:

a tube, having at least one open end, a second end, and a sidewall extending therebetween;

a closure adapted for sealing engagement with the open end of the tube, the closure defining a recess; and a mechanical separator releasably engaged within the recess, the mechanical separator comprising:

a float;

a ballast assembly longitudinally moveable with respect to the float; and a bellows structure comprising a first end, a second end, and a deformable bellows therebetween, wherein the float is attached to a portion of the first end by releasable interference engagement therebetween for maintaining the float in fixed relation with respect to the bellows structure, and the ballast assembly is attached to a portion of the second end, wherein the releasable interference engagement comprises an interior engagement portion that extends into the interior and engages an interior portion of the float.

27. The separation assembly of claim 26, wherein the float has a first density, and the ballast assembly has a second density that is greater than the first density of the float.

28. The separation assembly of claim 26, wherein the bellows structure defines an interior and the float is releasably retained within a portion of the interior of the bellows structure.

29. The separation assembly of claim 26, wherein the releasable interference engagement is adapted to release upon centrifugation.

30. The separation assembly of claim 26, wherein the releasable interference engagement is configured to release upon the float exceeding a centrifugal force of at least 250 g.

31. The separation assembly of claim 26, wherein release of the float from the first end of the bellows structure releases the mechanical separator from the recess of the closure.

32. The separation assembly of claim 26, wherein the ballast assembly comprises a first ballast section and a second ballast section joined to the first ballast section through a portion of the bellows structure.

33. The separation assembly of claim 32, wherein the first ballast section and the second ballast section are opposingly oriented about a longitudinal axis of the mechanical separator.

34. The separation assembly of claim 26, wherein the float comprises a head portion defining an opening therethrough to allow the venting of air from within an interior of the float to an area exterior of the mechanical separator.

35. The separation assembly of claim 26, wherein the bellows structure comprises a venting slit to allow the venting of air from within an interior of the float to an area exterior of the mechanical separator.

36. The separation assembly of claim 26, wherein the bellows structure comprises a venting slit to allow the venting of air from a chamber defined by an interior of the bellows structure and an exterior of the float to an area exterior of the mechanical separator.

37. The separation assembly of claim 26, further comprising a moveable plug disposed within an interior of the float.

* * * * *